US009792844B2

(12) United States Patent
Miyake et al.

(10) Patent No.: US 9,792,844 B2
(45) Date of Patent: Oct. 17, 2017

(54) DRIVING METHOD OF IMAGE DISPLAY DEVICE IN WHICH THE INCREASE IN LUMINANCE AND THE DECREASE IN LUMINANCE COMPENSATE FOR EACH OTHER

(75) Inventors: Hiroyuki Miyake, Kanagawa (JP); Seiko Inoue, Kanagawa (JP)

(73) Assignee: Seminconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 13/298,341

(22) Filed: Nov. 17, 2011

(65) Prior Publication Data

US 2012/0127384 A1 May 24, 2012

(30) Foreign Application Priority Data

Nov. 23, 2010 (JP) ..... 2010-260717

(51) Int. Cl.
*G09G 3/00* (2006.01)
*G09G 3/36* (2006.01)

(52) U.S. Cl.
CPC ..... *G09G 3/003* (2013.01); *G09G 3/3677* (2013.01); *G09G 2310/0205* (2013.01); *G09G 2310/0235* (2013.01); *G09G 2310/061* (2013.01)

(58) Field of Classification Search
CPC ..... G09G 3/003; G09G 3/3677; G09G 2310/061; G09G 2310/0235; G09G 2310/0205
USPC ..... 345/7–9, 87–104, 690; 349/15
See application file for complete search history.

(56) References Cited

U.S. PATENT DOCUMENTS

| | | | | |
|---|---|---|---|---|
| 6,046,787 | A | 4/2000 | Nishiguchi | |
| 6,239,453 | B1 | 5/2001 | Yamada et al. | |
| 6,314,248 | B1 | 11/2001 | Ohmura et al. | |
| 6,448,951 | B1 * | 9/2002 | Sakaguchi | G09G 3/3413 345/102 |
| 6,570,554 | B1 | 5/2003 | Makino et al. | |
| 6,580,405 | B1 | 6/2003 | Yamazaki et al. | |
| 6,597,348 | B1 | 7/2003 | Yamazaki et al. | |
| 6,730,966 | B2 | 5/2004 | Koyama | |

(Continued)

FOREIGN PATENT DOCUMENTS

| | | |
|---|---|---|
| EP | 2 136 354 A2 | 12/2009 |
| JP | 11-331879 A | 11/1999 |

(Continued)

*Primary Examiner* — Lisa Landis
(74) *Attorney, Agent, or Firm* — Fish & Richardson P.C.

(57) ABSTRACT

A display device capable of high-quality stereoscopic display without decreasing resolution is provided. A pixel portion including a plurality of pixels arranged in matrix is divided into plural regions, lighting of backlight units each emitting light of different hues is controlled in each region, and the backlight units of the plural regions are turned off simultaneously at a regular interval so as to display black. The right-eye image and the left-eye image are alternately displayed with black display interposed therebetween, and light incident on the right eye of a viewer is blocked when a left-eye image is displayed, and light incident on the left eye of the viewer is blocked when a right-eye image is displayed. An image signal is written into a pixel in a black display period during which the backlight units are turned off.

4 Claims, 15 Drawing Sheets

(56) References Cited

U.S. PATENT DOCUMENTS

| | | | | |
|---|---|---|---|---|
| 6,982,462 | B2 | 1/2006 | Koyama | |
| 7,045,369 | B2 | 5/2006 | Yamazaki et al. | |
| 7,317,438 | B2 | 1/2008 | Yamazaki et al. | |
| 7,345,661 | B2 | 3/2008 | Miyagawa et al. | |
| 7,385,579 | B2 | 6/2008 | Satake | |
| 7,385,625 | B2 | 6/2008 | Ohmura et al. | |
| 7,403,177 | B2 | 7/2008 | Tanada et al. | |
| 7,525,119 | B2 | 4/2009 | Koyama | |
| 7,727,779 | B2 | 6/2010 | Yamazaki et al. | |
| 7,834,830 | B2 | 11/2010 | Yamazaki et al. | |
| 7,968,368 | B2 | 6/2011 | Wakana et al. | |
| 8,902,209 | B2 | 12/2014 | Koyama | |
| 9,462,260 | B2 | 10/2016 | Koyama | |
| 2001/0000335 | A1 | 4/2001 | Yamada et al. | |
| 2002/0001472 | A1 | 1/2002 | Ohmura et al. | |
| 2004/0263499 | A1* | 12/2004 | Tanada et al. | 345/204 |
| 2008/0259099 | A1* | 10/2008 | Arai | G09G 3/2003 345/690 |
| 2008/0284719 | A1* | 11/2008 | Yoshida | G02F 1/136277 345/102 |
| 2009/0218573 | A1 | 9/2009 | Koyama | |
| 2009/0237495 | A1 | 9/2009 | Kawahara | |
| 2009/0303219 | A1 | 12/2009 | Kimura et al. | |
| 2010/0065840 | A1 | 3/2010 | Yamazaki et al. | |
| 2010/0265222 | A1* | 10/2010 | Tsuboi et al. | 345/205 |
| 2010/0289969 | A1 | 11/2010 | Yamazaki et al. | |
| 2011/0025729 | A1 | 2/2011 | Yamazaki et al. | |
| 2011/0050861 | A1* | 3/2011 | Sakamoto | G02B 27/2242 348/51 |
| 2011/0242100 | A1 | 10/2011 | Yamazaki et al. | |
| 2012/0026163 | A1 | 2/2012 | Koyama et al. | |
| 2013/0088534 | A1 | 4/2013 | Arai et al. | |

FOREIGN PATENT DOCUMENTS

| | | | |
|---|---|---|---|
| JP | 11-337904 | A | 12/1999 |
| JP | 2001-133746 | A | 5/2001 |
| JP | 2003-066920 | A | 3/2003 |
| JP | 2003-259395 | A | 9/2003 |
| JP | 2006-220685 | A | 8/2006 |
| JP | 2007-073563 | A | 3/2007 |
| JP | 2007-264211 | A | 10/2007 |
| JP | 2008-268322 | A | 11/2008 |
| JP | 2008-268398 | A | 11/2008 |
| JP | 2009-031523 | A | 2/2009 |
| JP | 2009-230071 | A | 10/2009 |
| JP | 2009-232249 | A | 10/2009 |
| JP | 2010-003766 | A | 1/2010 |
| JP | 2010-020292 | A | 1/2010 |
| JP | 2010-092036 | A | 4/2010 |
| JP | 2010-192560 | A | 9/2010 |
| JP | 2010-256420 | A | 11/2010 |
| WO | WO-2010/029866 | | 3/2010 |

* cited by examiner

DRIVING METHOD OF IMAGE DISPLAY DEVICE IN WHICH THE INCREASE IN LUMINANCE AND THE DECREASE IN LUMINANCE COMPENSATE FOR EACH OTHER

BACKGROUND OF THE INVENTION

1. Field of the Invention

One embodiment of the present invention relates to a display device and a driving method of the display device.

In this specification, a semiconductor device means all types of devices which can function by utilizing semiconductor characteristics, and a semiconductor circuit, a memory device, an imaging device, a display device, an electro-optical device, an electronic device, and the like are all semiconductor devices.

2. Description of the Related Art

In recent years, display devices which can show pseudo stereoscopic images (three-dimensional images), such as a display device using a liquid crystal display device and a display device using an electroluminescent display device (also referred to as an EL display device), have been developed.

Examples of the display device which can show pseudo three-dimensional images include a display device making a viewer perceive two-dimensional images as three-dimensional images by utilizing parallax between the left eye and the right eye. In such a display device, for example, an image for the left eye (hereinafter referred to as a left-eye image) and an image for the right eye (hereinafter referred to as a right-eye image) are alternately displayed on a pixel portion, and a viewer sees the images with use of eyeglasses provided with shutters corresponding to both eyes. When a left-eye is displayed as a display image, the shutter for the right eye of the eyeglasses is closed, and light incident on the right eye of the viewer is blocked. When a right-eye image is displayed as a display image, the shutter for the left eye of the eyeglasses is closed, and light incident on the left eye of the viewer is blocked. As a result, two-dimensional images can be seen as pseudo three-dimensional images.

In addition, the following method (for example, Patent Document 1) is known. In each time of displaying a left-eye image and displaying a right-eye image, a unit frame period for displaying the image is divided into a plurality of subframe periods. A color of light emitted from a light unit (including a backlight) to a pixel circuit (also referred to as a display circuit) is changed every subframe period, whereby a full-color image is displayed every unit frame period (this method is called a field sequential method). When a field sequential method is employed, for example, a color filter is not needed in the liquid crystal display device, and thus, light transmittance can be increased.

In addition, a method in which the left-eye images and the right-eye images are each displayed continuously over a plurality of frame periods is known (for example, Patent Document 2). By the above method, an interval between operation of switching between a shutter for the left eye and a shutter for the right eye of the eyeglasses can be prolonged; thus, crosstalk can be suppressed even in the case of increasing the frame frequency.

REFERENCE

Patent Document

[Patent Document 1] Japanese Published Patent Application No. 2003-259395

[Patent Document 2] Japanese Published Patent Application No. 2009-031523

SUMMARY OF THE INVENTION

In a field-sequential liquid crystal display device, it is necessary to increase the frequency of input of an image signal to each pixel. For example, in the case where three-dimensional images are not displayed, in a field-sequential liquid crystal display device which includes light sources (a backlight) of three colors, red (R), green (G), and blue (B), the frequency of input of image signals to each pixel needs to be at least three times as high as that in a color-filter liquid crystal display device which includes a light source (a backlight) of white light. Specifically, in the case where the frame frequency is 60 Hz, it is necessary to input image signals to each pixel 60 times per second in a color-filter liquid crystal display device; on the other hand, it is necessary to input image signals to each pixel 180 times per second in a field-sequential liquid crystal display device which includes light sources (a backlignt) of three colors, red (R), green (G), and blue (B).

In the case where a field-sequential liquid crystal display device displays three-dimensional images, a period for displaying black (K) is needed in addition to periods for displaying the above three colors in order to switch the left-eye image and the right-eye image. Therefore, in the case where the field-sequential liquid crystal display device displays three-dimensional images, it is necessary to input image signals to each pixel 480 times per second.

As described above, in the field-sequential liquid crystal display device, color information is time-divided. For that reason, display perceived by a user is sometimes changed from display based on original display data because of a lack of given display data due to temporary interruption of display, such as a blink of the user (such a phenomenon is also referred to as color break or color breakup); thus, the display image quality is decreased.

An object of one embodiment of the present invention is to provide a display device with high display quality by suppressing decrease in image quality.

An object of one embodiment of the present invention is to provide a display device with low power consumption.

An object of one embodiment of the present invention is to provide a display device that can perform favorable stereoscopic display without decreasing resolution.

With use of a backlight including a plurality of backlight units each supplying light of different hues, writing of an image signal and lighting of the backlight are performed in individual regions or in individual backlight units in a pixel portion. Accordingly, a period during which a backlight is turned off can be shorter than that in a conventional method in which an image signal is written into the whole pixel portion and then a backlight is lit; therefore, a display device with high brightness and high display quality can be achieved.

One embodiment of the present invention is a driving method of a display device, in which a pixel portion including a plurality of pixels arranged in matrix is divided into plural regions, lighting of backlight units each emitting light of different hues is controlled in each region, and the backlight units of the plural regions are turned off simultaneously at a regular interval so as to display black.

The right-eye image and the left-eye image are alternately displayed with black display interposed therebetween, and light incident on the right eye of a viewer is blocked when a left-eye image is displayed, and light incident on the left eye of the viewer is blocked when a right-eye image is displayed. In addition, an image signal is written into a pixel in a black display period during which the backlight units are turned off, whereby display quality can be increased.

One embodiment of the present invention is a driving method of a liquid crystal display device including a pixel portion including a first region, a second region adjacent to the first region, and a third region adjacent to the second region; a plurality of pixels arranged in matrix in the first region, the second region, and the third region; and a plurality of backlight units overlapping with the plurality of pixels, in which a first subframe period, a second subframe period, a third subframe period, a fourth subframe period, a first hue display period, a second hue display period, a third hue display period, and a black display period are provided. In the driving method of a liquid crystal display device, during the first subframe period, the first hue is displayed in the first region, the third hue is displayed in the second region, and the second hue is displayed in the third region; during the second subframe period, the second hue is displayed in the first region, the first hue is displayed in the second region, and the third hue is displayed in the third region; during the third subframe period, the third hue is displayed in the first region, the second hue is displayed in the second region, and the first hue is displayed in the third region; and during the fourth subframe period, black is displayed in the first to third regions.

Another embodiment of the present invention is a driving method of a display device including: a pixel portion including a first region, a second region adjacent to the first region, and a third region adjacent to the second region; a plurality of pixels arranged in matrix in the first region, the second region, and the third region; and a plurality of backlight units for supplying light of a first hue, light of a second hue, and light of a third hue, the plurality of backlight units overlapping with the plurality of pixels, wherein a right-eye image display period for displaying a right-eye image and a left-eye image display period for displaying a left-eye image are provided, wherein the right-eye image display period and the left-eye image display period each comprise a first subframe period, a second subframe period, a third subframe period, and a fourth subframe period, wherein during the first subframe period, a first hue signal is supplied to the plurality of pixels included in the first region, and then the backlight unit supplies the light of the first hue; a third hue signal is supplied to the plurality of pixels included in the second region, and then the backlight unit supplies the light of the third hue; and a second hue signal is supplied to the plurality of pixels included in the third region, and then the backlight unit supplies the light of the second hue, wherein during the second subframe period, the second hue signal is supplied to the plurality of pixels included in the first region, and then the backlight unit supplies the light of the second hue; the first hue signal is supplied to the plurality of pixels included in the second region, and then the backlight unit supplies the light of the first hue; and the third hue signal is supplied to the plurality of pixels included in the third region, and then the backlight unit supplies the light of the third hue, wherein during the third subframe period, the third hue signal is supplied to the plurality of pixels included in the first region, and then the backlight unit supplies the light of the third hue; the second hue signal is supplied to the plurality of pixels included in the second region, and then the backlight unit supplies the light of the second hue; and the first hue signal is supplied to the plurality of pixels included in the third region, and then the backlight unit supplies the light of the first hue, wherein during the fourth subframe period, the plurality of backlight units in the first region, the second region, and the third region is turned off, and wherein the right-eye image and the left-eye image are displayed alternately.

In the first subframe period, a hue signal which is the same as a hue signal held in the fourth subframe period is held in a pixel included in the first region and adjacent to the second region.

In the first subframe period, a hue signal which is the same as a hue signal held in the fourth subframe period is held in a pixel included in the second region and adjacent to the third region.

In the fourth subframe period, a hue signal which is the same as a hue signal held in the first subframe period is held in a pixel included in the second region and adjacent to the first region.

In the fourth subframe period, a hue signal which is the same as a hue signal held in the first subframe period is held in a pixel included in the third region and adjacent to the second region.

The right-eye image and the left-eye image are displayed alternately, whereby three-dimensional images can be preceived by a viewer.

A display device with high display quality can be provided.

A display device with low power consumption can be provided.

A display device that can perform favorable stereoscopic display can be provided without decreasing resolution.

DETAILED DESCRIPTION OF THE INVENTION

Figure 1A:
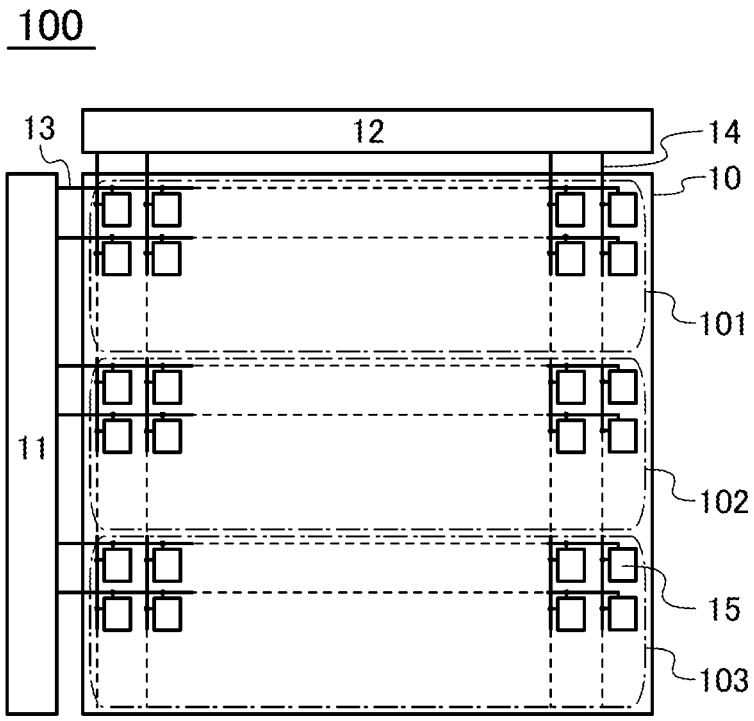
FIGS. 1A and 1B illustrate a structure example of a liquid crystal display device.

Hereinafter, embodiments of the present invention will be described with reference to the accompanying drawings. Note that the present invention can be carried out in many different modes, and it is easily understood by those skilled in the art that modes and details of the present invention can be modified in various ways without departing from the spirit and scope of the present invention. Therefore, the present invention is not interpreted as being limited to the description of the embodiments below. Note that in structures of the present invention described below, reference numerals denoting the same portions are used in common in different drawings.

Note that the size, the thickness of a layer, a signal waveform, and a region of each structure illustrated in the drawings and the like in the embodiments are exaggerated for simplicity in some cases. Therefore, the embodiments of the present invention are not limited to such scales.

Note that terms such as first, second, third to N-th (N is a natural number) employed in this specification are used in order to avoid confusion between components and do not set a limitation on number. The natural number is 1 or more unless otherwise specified.

A transistor is a kind of semiconductor elements and can achieve amplification of current or voltage, switching operation for controlling conduction or non-conduction, or the like. A transistor in this specification includes an insulated-gate field effect transistor (IGFET) and a thin film transistor (TFT).

Functions of a "source" and a "drain" of a transistor might interchange when a transistor of opposite polarity is used or the direction of current flow is changed in circuit operation, for example. Therefore, the terms "source" and "drain" can be replaced with each other in this specification.

Embodiment 1

In this embodiment, a liquid crystal display device which is one embodiment of the present invention is described with reference to FIGS. 1A and 1B, FIGS. 2A to 2C, FIGS. 3A to 3D, FIG. 4, FIGS. 5A and 5B, FIGS. 6A and 6B, FIG. 7, FIG. 8, FIG. 9, FIGS. 10A and 10B, and FIGS. 11A to 11G.

<Structure Example of Liquid Crystal Display Device>

FIG. 1A illustrates a structure example of a liquid crystal display device 100. The liquid crystal display device 100 illustrated in FIG. 1A includes a pixel portion 10, a scan line driver circuit 11, a signal line driver circuit 12, m scan lines 13 arranged in parallel or in substantially parallel, whose potentials are controlled by the scan line driver circuit 11, and n signal lines 14 arranged in parallel or in substantially parallel, whose potentials are controlled by the signal line driver circuit 12. The pixel portion 10 is divided into three regions (regions 101 to 103), and each region includes a plurality of pixels 15 arranged in matrix.

The scan lines 13 are electrically connected to respective n pixels in respective rows, among the plurality of pixels arranged in m rows by n columns in the pixel portion 10 (m is a natural number larger than or equal to 12, and n is a natural number). In addition, the signal lines 14 are electrically connected to respective m pixels in respective columns, among the plurality of pixels arranged in m rows by n columns.

The m scan lines 13 are divided into a plurality of groups in accordance with the number of regions included in the pixel portion 10. For example, the m scan lines 13 are divided into three groups because the pixel portion 10 is divided into three regions in FIG. 1A. The scan lines 13 in each group are electrically connected to the plurality of pixels 15 in a region corresponding to the group. Specifically, in each of the regions, each of the scan lines 13 is electrically connected to n pixels 15 in a corresponding row, among the plurality of pixels 15 arranged in matrix.

Regardless of the above regions, the n signal lines 14 are electrically connected to respective m pixels 15 in respective columns, among the plurality of pixels 15 arranged in m rows by n columns in the pixel portion 10.

Figure 1B:
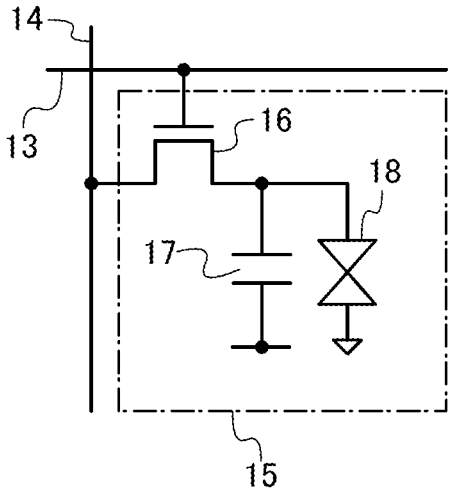

FIG. 1B illustrates an example of a circuit configuration of a pixel 15 included in the pixel portion 10 illustrated in FIG. 1A. The pixel 15 illustrated in FIG. 1B includes a transistor 16, a capacitor 17, and a liquid crystal element 18.

A gate of the transistor 16 is electrically connected to the scan line 13 and one of a source and a drain thereof is electrically connected to the signal line 14. One electrode of the capacitor 17 is electrically connected to the other of the source and the drain of the transistor 16. The other electrode of the capacitor 17 is electrically connected to a wiring for supplying a capacitor potential (the wiring is also referred to as a capacitor wiring). One of electrodes (also referred to as a pixel electrode) of the liquid crystal element 18 is electrically connected to the other of the source and the drain of the transistor 16 and the one electrode of the capacitor 17, and the other electrode (also referred to as a counter electrode) of the liquid crystal element 18 is electrically connected to a wiring for supplying a counter potential.

Note that although the transistor 16 is an n-channel transistor in this embodiment, the transistor 16 may be a p-channel transistor. The capacitor potential and the counter potential can be equal to each other.

<Configuration Example of Scan Line Driver Circuit>

Figure 2A:
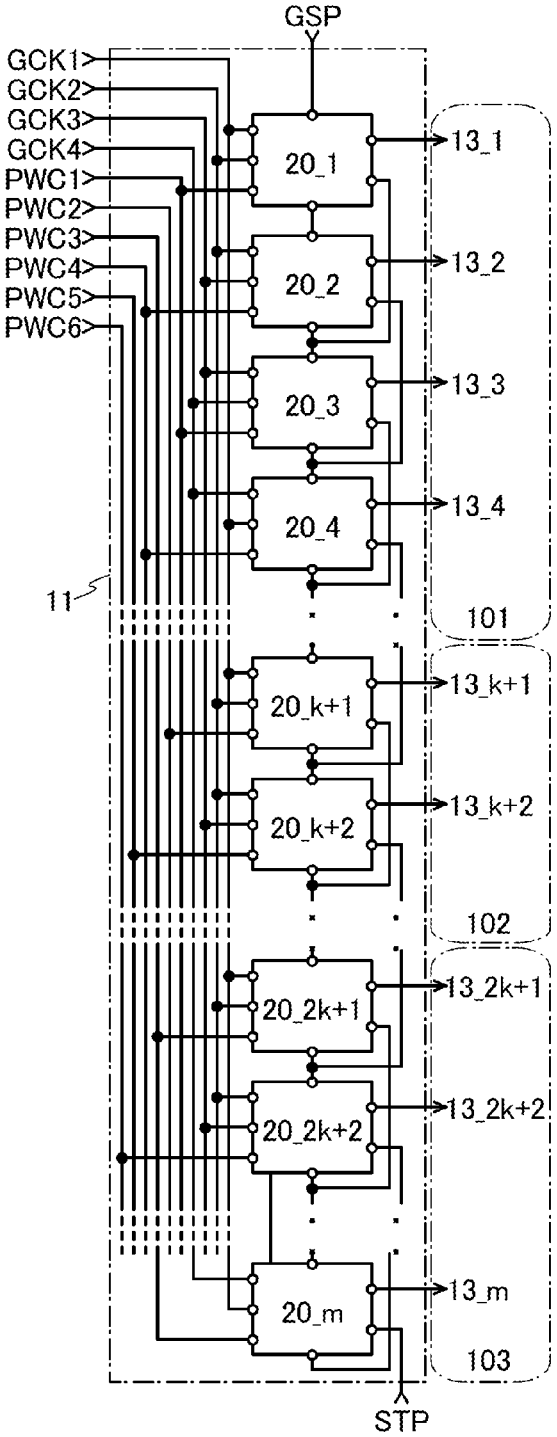
FIGS. 2A and 2C illustrate a configuration example and FIG. 2B illustrates an operation example of a scan line driver circuit.

FIG. 2A illustrates a configuration example of the scan line driver circuit 11 included in the liquid crystal display device 100 illustrated in FIG. 1A. The scan line driver circuit 11 illustrated in FIG. 2A includes: wirings for supplying respective first to fourth scan line driver circuit clock signals (GCK1 to GCK4); wirings for supplying respective first to sixth pulse-width control signals (PWC1 to PWC6); and a first pulse output circuit 20_1 which is electrically connected to the scan line 13 in the first row to an m-th pulse output circuit 20_*m* which is electrically connected to the scan line 13 in the m-th row.

In this embodiment, the first pulse output circuit 20_1 to the k-th pulse output circuit 20_*k* (k is a natural number less than or equal to m/3) are electrically connected to scan lines 13_1 to 13_*k* provided in the region 101, respectively. In this embodiment, k is preferably a multiple of the number of clock signals (GCK1 to GCK4) supplied to the scan line driver circuit 11, i.e., a multiple of 4.

In addition, the (k+1)th to 2k-th pulse output circuits 20_*k*+1 to 20_2k are electrically connected to the scan lines 13_*k*+1 to 13_2k provided in the region 102. Further, the (2k+1)th to m-th pulse output circuits 20_2k+1 to 20_*m* are electrically connected to the scan lines 13_2k+1 to 13_*m* provided in the region 103.

The first to m-th pulse output circuits 20_1 to 20_*m* have a function of sequentially shifting a shift pulse in each shift period in response to a scan line driver circuit start pulse GSP which is input to the first pulse output circuit 20_1. Further, a plurality of shift pulses can be shifted in the first to m-th pulse output circuits 20_1 to 20_*m* concurrently. In other words, even in a period during which a shift pulse is shifted in the first to m-th pulse output circuits 20_1 to **20_*m*, the scan line driver circuit start pulse GSP can be input to the first pulse output circuit 20_1**.

Figure 2B:
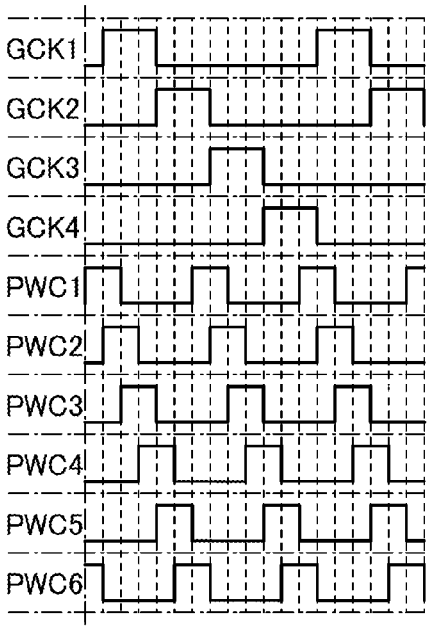

FIG. 2B illustrates examples of specific operation of the above signals. The first scan line driver circuit clock signal (GCK1) in FIG. 2B periodically repeats a high-level potential (high power supply potential ($V_{dd}$)) and a low-level potential (low power supply potential ($V_{ss}$)) and has a duty ratio of 1/4. The phase of the second scan line driver circuit clock signal (GCK2) is shifted from the first scan line driver circuit clock signal (GCK1) by ¼ period. The phase of the third scan line driver circuit clock signal (GCK3) is shifted from the first scan line driver circuit clock signal (GCK1) by ½ period. The phase of the fourth scan line driver circuit clock signal (GCK4) is shifted from the first scan line driver circuit clock signal (GCK1) by ¾ period.

The first pulse width control signal (PWC1) in FIG. 2B periodically repeats the high-level potential (high power supply potential ($V_{dd}$)) and the low-level potential (low power supply potential ($V_{ss}$)) and has a duty ratio of 1/3. The phase of the second pulse width control signal (PWC2) is shifted from the first pulse width control signal (PWC1) by ⅙ period. The phase of the third pulse width control signal (PWC3) is shifted from the first pulse width control signal (PWC1) by ⅓ period. The phase of the fourth pulse width control signal (PWC4) is shifted from the first pulse width control signal (PWC1) by ½ period. The phase of the fifth pulse width control signal (PWC5) is shifted from the first pulse width control signal (PWC1) by ⅔ period. The phase of the sixth pulse width control signal (PWC6) is shifted from the first pulse width control signal (PWC1) by ⅚ period.

Note that here, the ratio of the pulse width of each of the first to fourth scan line driver circuit clock signals (GCK1 to GCK4) to the pulse width of each of the first to sixth pulse width control signals (PWC1 to PWC6) is 3:2.

In the liquid crystal display device 100, circuits with the same configuration can be used as the first to m-th pulse output circuits 20_1 to **20_*m*. Note that electrical connection relations of a plurality of terminals included in the pulse output circuit differ depending on the pulse output circuits. Specific connection relations are described with reference to FIGS. 2A and 2**C.

Each of the first to m-th pulse output circuits 20_1 to **20_*m* has terminals 21 to 27. The terminals 21 to 24 and the terminal 26 are input terminals. The terminals 25 and 27** are output terminals.

First, the terminal 21 is described. The terminal 21 in the first pulse output circuit 20_1 is electrically connected to a wiring that supplies the scan line driver circuit start signal (GSP). The terminal 21 in each of the second to m-th pulse output circuits 202 to **20_*m* is electrically connected to the terminal 27** in the pulse output circuit in the preceding stage.

Next, the terminal 22 is described. The terminal 22 in the (4a−3)th pulse output circuit (a is a natural number less than or equal to m/4) is electrically connected to the wiring that supplies the first scan line driver circuit clock signal (GCK1). The terminal 22 in the (4a−2)th pulse output circuit is electrically connected to the wiring that supplies the second scan line driver circuit clock signal (GCK2). The terminal 22 in the (4a−1)th pulse output circuit is electrically connected to the wiring that supplies the third scan line driver circuit clock signal (GCK3). The terminal 22 in the 4a-th pulse output circuit is electrically connected to the wiring that supplies the fourth scan line driver circuit clock signal (GCK4).

Then, the terminal 23 is described. The terminal 23 in the (4a−3)th pulse output circuit is electrically connected to the wiring that supplies the second scan line driver circuit clock signal (GCK2). The terminal 23 in the (4a−2)th pulse output circuit is electrically connected to the wiring that supplies the third scan line driver circuit clock signal (GCK3). The terminal 23 in the (4a−1)th pulse output circuit is electrically connected to the wiring that supplies the fourth scan line driver circuit clock signal (GCK4). The terminal 23 in the 4a-th pulse output circuit is electrically connected to the wiring that supplies the first scan line driver circuit clock signal (GCK1).

Next, the terminal 24 is described. The terminal 24 in the (2b−1)th pulse output circuit (b is a natural number less than or equal to k/2) is electrically connected to the wiring that supplies the first pulse width control signal (PWC1). The terminal 24 in the 2b-th pulse output circuit is electrically connected to the wiring that supplies the fourth pulse width control signal (PWC4). The terminal 24 in the (2c−1)th pulse output circuit (c is a natural number greater than or equal to (k/2+1) and less than or equal to k) is electrically connected to the wiring that supplies the second pulse width control signal (PWC2). The terminal 24 in the 2c-th pulse output circuit is electrically connected to the wiring that supplies the fifth pulse width control signal (PWC5). The terminal 24 in the (2d−1)th pulse output circuit (d is a natural number greater than or equal to (k+1) and less than or equal to m/2) is electrically connected to the wiring that supplies the third pulse width control signal (PWC3). The terminal 24 in the 2d-th pulse output circuit is electrically connected to the wiring that supplies the sixth pulse width control signal (PWC6).

Then, the terminal 25 is described. The terminal 25 in the x-th pulse output circuit (x is a natural number less than or equal to m) is electrically connected to the scan line **13_*x*** in the x-th row.

Next, the terminal 26 is described. The terminal 26 in the y-th pulse output circuit (y is a natural number less than or equal to (m−1)) is electrically connected to the terminal 27 in the (y+1)th pulse output circuit. The terminal 26 in the m-th pulse output circuit is electrically connected to a wiring that supplies an m-th pulse output circuit stop signal (STP).

Note that if an (m+1)th pulse output circuit is provided, the m-th pulse output circuit stop signal (STP) corresponds to a signal output from the terminal 27 in the (m+1)th pulse output circuit. Specifically, the m-th pulse output circuit stop signal (STP) can be supplied to the m-th pulse output circuit by provision of the (m+1)th pulse output circuit as a dummy circuit or by direct input of the signal from the outside.

The connection relation of the terminal 27 in each of the pulse output circuits is described above. Thus, the above description is referred to here.

<Configuration Example of Pulse Output Circuit>

Figure 2C:
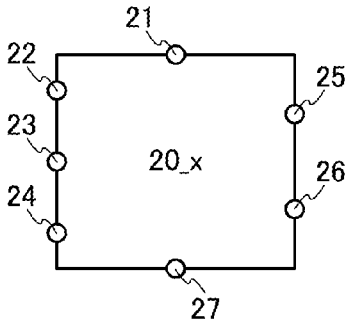
Figure 3A:
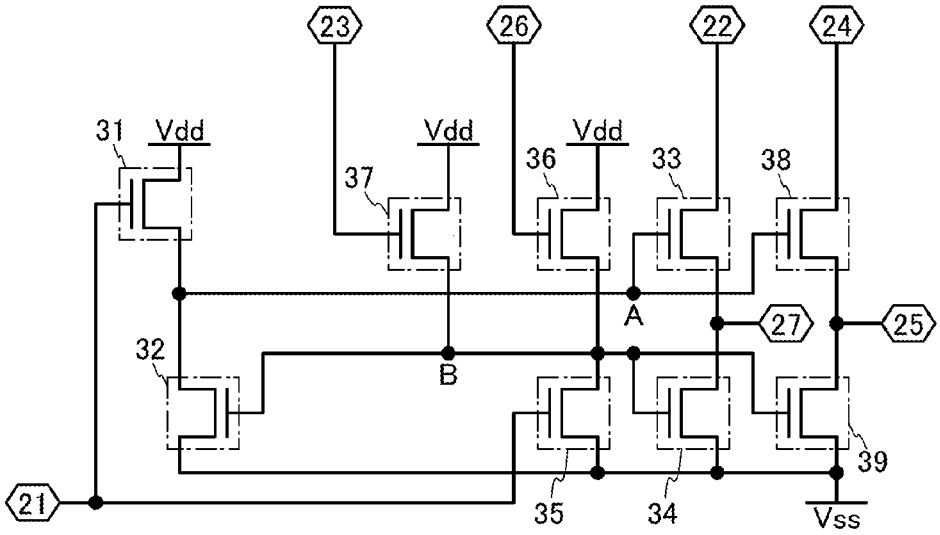
FIG. 3A illustrates a configuration example and FIGS. 3B to 3D illustrate operation examples of pulse output circuits.

FIG. 3A illustrates a configuration example of the pulse output circuit illustrated in FIGS. 2A and 2C. The pulse output circuit illustrated in FIG. 3A includes transistors 31 to 39.

One of a source and a drain of the transistor 31 is electrically connected to a wiring that supplies the high power supply potential ($V_{dd}$) (hereinafter also referred to as a high power supply potential line). A gate of the transistor 31 is electrically connected to the terminal 21.

One of a source and a drain of the transistor 32 is electrically connected to a wiring that supplies the low power supply potential ($V_{ss}$) (hereinafter also referred to as a low power supply potential line). The other of the source and the drain of the transistor 32 is electrically connected to the other of the source and the drain of the transistor 31.

One of a source and a drain of the transistor 33 is electrically connected to the terminal 22. The other of the source and the drain of the transistor 33 is electrically connected to the terminal 27. A gate of the transistor 33 is electrically connected to the other of the source and the drain of the transistor 31 and the other of the source and the drain of the transistor 32.

One of a source and a drain of the transistor 34 is electrically connected to the low power supply potential line, the other of the source and the drain of the transistor 34 is electrically connected to the terminal 27, and a gate of the transistor 34 is electrically connected to a gate of the transistor 32.

One of a source and a drain of the transistor 35 is electrically connected to the low power supply potential line. The other of the source and the drain of the transistor 35 is electrically connected to a gate of the transistor 32 and a gate of the transistor 34. A gate of the transistor 35 is electrically connected to the terminal 21.

One of a source and a drain of the transistor 36 is electrically connected to the high power supply potential line. The other of the source and the drain of the transistor 36 is electrically connected to the gate of the transistor 32, the gate of the transistor 34, and the other of the source and the drain of the transistor 35. A gate of the transistor 36 is electrically connected to the terminal 26.

One of a source and a drain of the transistor 37 is electrically connected to the high power supply potential line. The other of the source and the drain of the transistor 37 is electrically connected to the gate of the transistor 32, the gate of the transistor 34, the other of the source and the drain of the transistor 35, and the other of the source and the drain of the transistor 36. A gate of the transistor 37 is electrically connected to the terminal 23.

One of a source and a drain of the transistor 38 is electrically connected to the terminal 24. The other of the source and the drain of the transistor 38 is electrically connected to the terminal 25. A gate of the transistor 38 is electrically connected to the other of the source and the drain of the transistor 31, the other of the source and the drain of the transistor 32, and the gate of the transistor 33.

One of a source and a drain of the transistor 39 is electrically connected to the low power supply potential line. The other of the source and the drain of the transistor 39 is electrically connected to the terminal 25. A gate of the transistor 39 is electrically connected to the gate of the transistor 32, the gate of the transistor 34, the other of the source and the drain of the transistor 35, the other of the source and the drain of the transistor 36, and the other of the source and the drain of the transistor 37.

Note that in the following description, a node to which the other of the source and the drain of the transistor 31, the other of the source and the drain of the transistor 32, the gate of the transistor 33, and the gate of the transistor 38 are electrically connected is referred to as a node A. In addition, a node to which the gate of the transistor 32, the gate of the transistor 34, the other of the source and the drain of the transistor 35, the other of the source and the drain of the transistor 36, the other of the source and the drain of the transistor 37, and the gate of the transistor 39 are electrically connected is referred to as a node B.

<Operation Example of Pulse Output Circuit>

An operation example of the pulse output circuit is described with reference to FIGS. 3B to 3D. Note that here, the following case is described: an operation example at the time when timing of inputting the scan line driver circuit start pulse (GSP) to the terminal 21 in the first pulse output circuit 20_1 is controlled so that shift pulses are output from the terminals 27 in the first pulse output circuit 20_1, the (k+1)th pulse output circuit 20_*k*+1, and the (2k+1)th pulse output circuit 20_2k+1 at the same timing.

Figure 3B:
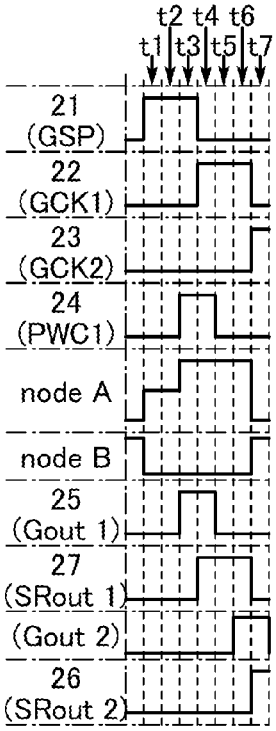

As a specific example, FIG. 3B illustrates the potentials of signals input to the terminals in the first pulse output circuit 20_1 and the potentials of the node A and the node B at the time when the scan line driver circuit start pulse (GSP) is input. FIG. 3C illustrates the potentials of signals input to the terminals in the (k+1)th pulse output circuit 20_*k*+1 and the potentials of the node A and the node B at the time when the high-level potential is input from the k-th pulse output circuit 20_*k*. FIG. 3D illustrates the potentials of signals input to the terminals in the (2k+1)th pulse output circuit 20_2k+1 and the potentials of the node A and the node B at the time when the high-level potential is input from the 2k-th pulse output circuit 20_2k.

Figure 3C:
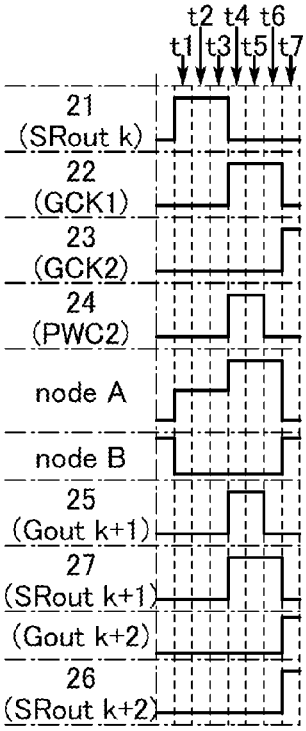
Figure 3D:
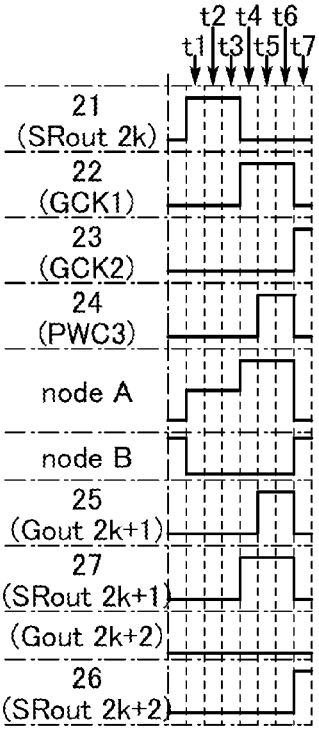

Note that in FIGS. 3B to 3D, the signals input to the terminals are provided in parentheses. Further, FIGS. 3B to 3D illustrate signals (Gout 2, Gout k+2, and Gout 2k+2) output from the terminals 25 in the pulse output circuits provided in subsequent stages (the second pulse output circuit 20_2, the (k+2)th pulse output circuit 20_*k*+2, and the (2k+2)th pulse output circuit 20_2k+2), and output signals of the terminals 27 in the pulse output circuits provided in subsequent stages (SRout 2: an input signal of the terminal 26 in the first pulse output circuit 20_1, SRout k+2: an input signal of the terminal 26 in the (k+1)th pulse output circuit 20_*k*+1, and SRout 2k+2: an input signal of the terminal 26 in the (2k+1)th pulse output circuit 20_2k+1). Note that in FIGS. 3B to 3D, Gout represents an output signal from the pulse output circuit to the scan line, and SRout represents an output signal from the pulse output circuit to the pulse output circuit in the subsequent stage.

First, the case where the high-level potential is input to the first pulse output circuit 20_1 as the scan line driver circuit start pulse (GSP) is described with reference to FIG. 3B.

In a period t1, the high-level potential (high power supply potential ($V_{dd}$)) is input to the terminal 21. Thus, the transistors 31 and 35 are turned on. As a result, the potential of the node A is increased to a high-level potential (a potential decreased from the high power supply potential ($V_{dd}$) by the threshold voltage of the transistor 31), and the potential of the node B is decreased to the low power supply potential ($V_{ss}$). Consequently, the transistors 33 and 38 are turned on and the transistors 32, 34, and 39 are turned off.

Thus, in the period t1, a signal output from the terminal 27 is a signal input to the terminal 22, and a signal output from the terminal 25 is a signal input to the terminal 24. Here, in the period t1, both the signal input to the terminal 22 and the signal input to the terminal 24 have the low-level potentials (low power supply potentials ($V_{ss}$)). Accordingly, in the period t1, the first pulse output circuit 20_1 outputs the low-level potential (low power supply potential ($V_{ss}$)) to the terminal 21 in the second pulse output circuit 20_2 and the scan line provided in the first row in the pixel portion.

In a period t2, signals input to the terminals are not changed from those in the period t1. Thus, the signals output from the terminals 25 and 27 are not changed, and the low-level potentials (low power supply potentials ($V_{ss}$)) are output from the terminals 25 and 27.

In a period t3, the high-level potential (high power supply potential ($V_{dd}$)) is input to the terminal 24. Note that the potential of the node A (the potential of the source of the transistor 31) is increased to the high-level potential (a potential decreased from the high power supply potential ($V_{dd}$) by the threshold voltage of the transistor 31) in the period t1. Thus, the transistor 31 is off. At this time, the high-level potential (high power supply potential ($V_{dd}$)) is input to the terminal 24, so that the potential of the node A (the potential of the gate of the transistor 38) is further increased by capacitive coupling of the source and the gate of the transistor 38 (bootstrap operation). Since the potential of the node A is increased by the bootstrap operation, the potential of the signal output from the terminal 25 is not decreased from the high-level potential (high power supply potential ($V_{dd}$)) input to the terminal 24. Accordingly, in the period t3, the first pulse output circuit 20_1 outputs the high-level potential (the high power supply potential ($V_{dd}$) =a selection signal) to the scan line provided in the first row in the pixel portion.

In a period t4, the high-level potential (high power supply potential ($V_{dd}$)) is input to the terminal 22. Here, since the potential of the node A is increased by the bootstrap operation, the potential of the signal output from the terminal 27 is not decreased from the high-level potential (high power supply potential ($V_{dd}$)) input to the terminal 22. Accordingly, in the period t4, the terminal 27 outputs the high-level potential (high power supply potential ($V_{dd}$)) which is input to the terminal 22. In other words, the first pulse output circuit 20_1 outputs the high-level potential (the high power supply potential ($V_{dd}$)=the shift pulse) to the terminal 21 in the second pulse output circuit 20_2. In the period t4, a signal input to the terminal 24 is kept at the high-level potential (high power supply potential ($V_{dd}$)); thus, the signal which is output from the first pulse output circuit 20_1 to the scan line provided in the first row in the pixel portion is kept at the high-level potential (the high power supply potential ($V_{dd}$)=the selection signal). Note that the transistor 35 is turned off because the low-level potential (low power supply potential ($V_{ss}$)) is input to the terminal 21, which does not directly influence output signals of the pulse output circuit in the period t4.

In a period t5, the low-level potential (low power supply potential ($V_{ss}$)) is input to the terminal 24. Here, the transistor 38 is kept on. Accordingly, in the period t5, a signal output from the first pulse output circuit 20_1 to the scan line provided in the first row in the pixel portion has the low-level potential (low power supply potential ($V_{ss}$)).

In a period t6, signals input to the terminals are not changed from those in the period t5. Thus, the signals output from the terminals 25 and 27 are not changed, the low-level potential (low power supply potential ($V_{ss}$)) is output from the terminal 25, and the high-level potential (high power supply potential ($V_{dd}$)=the shift pulse) is output from the terminal 27.

In a period t7, the high-level potential (high power supply potential ($V_{dd}$)) is input to the terminal 23. Thus, the transistor 37 is turned on. Accordingly, the potential of the node B is increased to the high-level potential (a potential decreased from the high power supply potential ($V_{dd}$) by the threshold voltage of the transistor 37). That is, the transistors 32, 34, and 39 are turned on. Consequently, the potential of the node A is decreased to the low-level potential (low power supply potential ($V_{ss}$)). That is, the transistors 33 and 38 are turned off. Thus, in the period t7, both the signals output from the terminals 25 and 27 have the low power supply potentials ($V_{ss}$). In other words, in the period t7, the first pulse output circuit 20_1 outputs the low power supply potential ($V_{ss}$) to the terminal 21 in the second pulse output circuit 20_2 and the scan line provided in the first row in the pixel portion.

Next, the case where the high-level potential is input as a shift pulse from the k-th pulse output circuit **20_*k* to the terminal 21 in the (k+1)th pulse output circuit 20_*k*+1 is described with reference to FIG. 3**C.

In the period t1 and the period t2, the operation of the (k+1)th pulse output circuit **20_*k*+1 is performed in a manner similar to that of the first pulse output circuit 20_1**. Thus, the above description is referred to here.

In the period t3, signals input to the terminals are not changed from those in the period t2. Thus, the signals output from the terminals 25 and 27 are not changed, and the low-level potentials (low power supply potentials ($V_{ss}$)) are output from the terminals 25 and 27.

In the period t4, the high-level potential (high power supply potential ($V_{dd}$)) is input to the terminals 22 and 24. Note that the potential of the node A (the potential of the source of the transistor 31) is increased to the high-level potential (a potential decreased from the high power supply potential ($V_{dd}$) by the threshold voltage of the transistor 31) in the period t1. Thus, the transistor 31 is off in the period t1. Here, the high-level potential (high power supply potential ($V_{dd}$)) is input to the terminals 22 and 24, so that the potential of the node A (the potentials of the gates of the transistors 33 and 38) is further increased by capacitive coupling of the source and the gate of the transistor 33 and capacitive coupling of the source and the gate of the transistor 38 (bootstrap operation). By the bootstrap operation, the potentials of the signals output from the terminals 25 and 27 are not decreased from the high-level potential (high power supply potential ($V_{dd}$)) input to the terminals 22 and 24. Thus, in the period t4, the (k+1)th pulse output circuit **20_*k*+1 outputs the high-level potential (high power supply potential ($V_{dd}$)=the selection signal, the shift pulse) to the scan line provided in the (k+1)th row in the pixel portion and the terminal 21 in the (k+2)th pulse output circuit 20_*k*+2**.

In the period t5, signals input to the terminals are not changed from those in the period t4. Thus, the signals output from the terminals 25 and 27 are not changed, and the high-level potential (high power supply potential ($V_{dd}$)=the selection signal, the shift pulse) is output.

In the period t6, the low-level potential (low power supply potential ($V_{ss}$)) is input to the terminal 24. Here, the transistor 38 is kept on. Accordingly, in the period t6, a signal output from the (k+1)th pulse output circuit **20_*k*+1** to the scan line provided in the (k+1)th row in the pixel portion has the low-level potential (low power supply potential ($V_{ss}$)).

In the period t7, the high-level potential (high power supply potential ($V_{dd}$)) is input to the terminal 23. Thus, the transistor 37 is turned on. Accordingly, the potential of the node B is increased to the high-level potential (a potential decreased from the high power supply potential ($V_{dd}$) by the threshold voltage of the transistor 37). That is, the transistors 32, 34, and 39 are turned on. Consequently, the potential of the node A is decreased to the low-level potential (low power supply potential ($V_{ss}$)). That is, the transistors 33 and 38 are turned off. Thus, in the period t7, both the signals output from the terminals 25 and 27 have the low power supply potentials ($V_{ss}$). In other words, in the period t7, the (k+1)th pulse output circuit **20_*k*+1 outputs the low power supply potential ($V_{ss}$) to the terminal 21 in the (k+2)th pulse output circuit 20_2** and the scan line provided in the (k+1)th row in the pixel portion.

Next, the case where the high-level potential is input as a shift pulse from the 2k-th pulse output circuit 20_2k to the terminal 21 in the (2k+1)th pulse output circuit 20_2k+1 is described with reference to FIG. 3D.

In the periods t1 to t3, the operation of the (2k+1)th pulse output circuit 20_2k+1 is performed in a manner similar to that of the (k+1)th pulse output circuit 20_*k*+1. Thus, the above description is referred to here.

In the period t4, the high-level potential (high power supply potential ($V_{dd}$)) is input to the terminal 22. Note that the potential of the node A (the potential of the source of the transistor 31) is increased to the high-level potential (a potential decreased from the high power supply potential ($V_{dd}$) by the threshold voltage of the transistor 31) in the period t1. Thus, the transistor 31 is off in the period t1. Here, the high-level potential (high power supply potential ($V_{dd}$)) is input to the terminal 22, so that the potential of the node A (the potential of the gate of the transistor 33) is further increased by capacitive coupling of the source and the gate of the transistor 33 (bootstrap operation). By the bootstrap operation, the potential of the signal output from the terminal 27 is not decreased from the high-level potential (high power supply potential ($V_{dd}$)) input to the terminal 22. Thus, in the period t4, the (2k+1)th pulse output circuit 20_*k*+1 outputs the high-level potential (high power supply potential ($V_{dd}$)=the shift pulse) to the terminal 21 in the (2k+2)th pulse output circuit 20_*k*+2. Note that the transistor 35 is turned off because the low-level potential (low power supply potential ($V_{ss}$)) is input to the terminal 21, which does not directly influence output signals of the pulse output circuit in the period t4.

In the period t5, the high-level potential (high power supply potential ($V_{dd}$)) is input to the terminal 24. Here, since the potential of the node A is increased by the bootstrap operation, the potential of the signal output from the terminal 25 is not decreased from the high-level potential (high power supply potential ($V_{dd}$)) input to the terminal 24. Accordingly, in the period t5, the terminal 25 outputs the high-level potential (high power supply potential ($V_{dd}$)) which is input to the terminal 22. In other words, the (2k+1)th pulse output circuit 20_2k+1 outputs the high-level potential (high power supply potential ($V_{dd}$)=the selection signal) to a scan line provided in a (2k+1)th row in the pixel portion. In the period t5, a signal input to the terminal 22 is kept at the high-level potential (high power supply potential ($V_{dd}$)); thus, the signal which is output from the (2k+1)th pulse output circuit 20_2k+1 to the terminal 21 in the (2k+2)th pulse output circuit 20_2k+2 is kept at the high-level potential (high power supply potential ($V_{dd}$)=the shift pulse).

In the period t6, signals input to the terminals are not changed from those in the period t5. Thus, the signals output from the terminals 25 and 27 are not changed, and the high-level potentials (high power supply potentials ($V_{dd}$) =the selection signals, the shift pulses) are output from the terminals 25 and 27.

In the period t7, the high-level potential (high power supply potential ($V_{dd}$)) is input to the terminal 23. Thus, the transistor 37 is turned on. Accordingly, the potential of the node B is increased to the high-level potential (a potential decreased from the high power supply potential ($V_{dd}$) by the threshold voltage of the transistor 37). That is, the transistors 32, 34, and 39 are turned on. Consequently, the potential of the node A is decreased to the low-level potential (low power supply potential ($V_{ss}$)). That is, the transistors 33 and 38 are turned off. Thus, in the period t7, both the signals output from the terminals 25 and 27 have the low power supply potentials ($V_{ss}$). In other words, in the period t7, the (k+1)th pulse output circuit 20_*k*+1 outputs the low power supply potential ($V_{ss}$) to the terminal 21 in the (k+2)th pulse output circuit 20_*k*+2 and the scan line provided in the (k+1)th row in the pixel portion.

As illustrated in FIGS. 3B to 3D, timing of inputting the scan line driver circuit start pulse (GSP) is controlled in the first to m-th pulse output circuits 20_1 to 20_*m*, so that a plurality of shift pulses can be shifted concurrently. Specifically, after the scan line driver circuit start pulse (GSP) is input, the scan line driver circuit start pulse (GSP) is input again at the same timing as the output of a shift pulse from the terminal 27 in the k-th pulse output circuit 20_*k*, so that shift pulses can be output from the first pulse output circuit 20_1 and the (k+1)th pulse output circuit 20_*k*+1 at the same timing. Similarly, the scan line driver circuit start pulse (GSP) is input, so that shift pulses can be output from the first pulse output circuit 20_1, the (k+1)th pulse output circuit 20_*k*+1, and the (2k+1)th pulse output circuit 20_2k+1 at the same timing.

In addition, the first pulse output circuit 20_1, the (k+1)th pulse output circuit 20_*k*+1, and the (2k+1)th pulse output circuit 20_2k+1 can supply selection signals to the scan lines at different timings in parallel to the above operation. In other words, the scan line driver circuit can shift a plurality of shift pulses having specific shift periods, and a plurality of pulse output circuits to which shift pulses are input at the same timing can supply selection signals to the scan lines at different timings.

<Operation Example of Scan Line Driver Circuit>

Next, an operation example of a scan line driver circuit is described.

Figure 4:
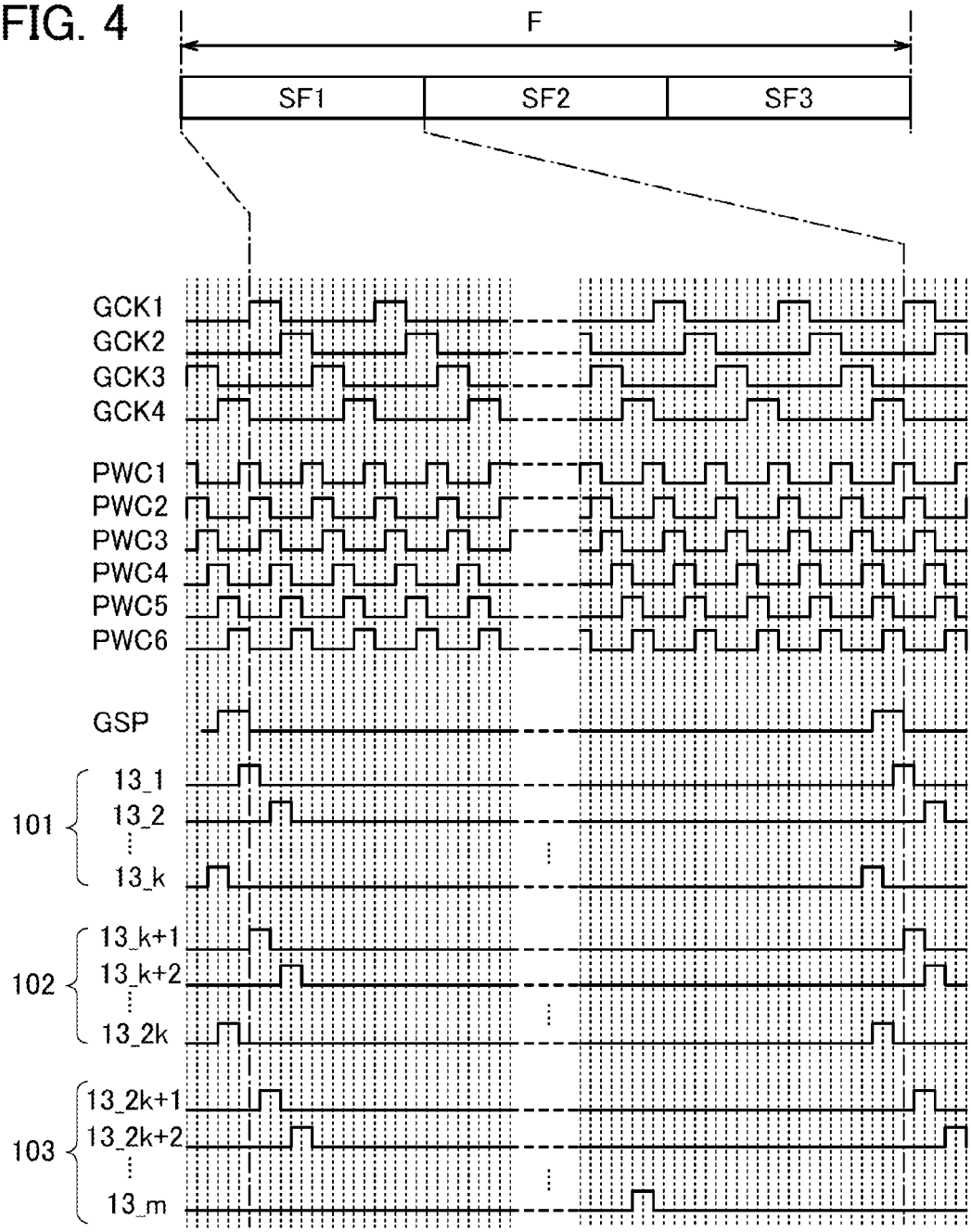
FIG. 4 illustrates an operation example of a scan line driver circuit.

FIG. 4 illustrates an example of a timing chart for explaining operation of the scan line driver circuit 11. FIG. 4 shows the case where a subframe period SF1, a subframe period SF2, and a subframe period SF3 are provided in one frame period. As a typical example of one subframe period, a timing chart of the subframe period SF1 is illustrated.

FIG. 4 illustrates a timing chart in the case where the scan lines 13_1 to 13_*k* are electrically connected to pixels in the region 101, the scan lines 13_*k*+1 to 13_2k are electrically connected to pixels in the region 102, and the scan lines 13_2k+1 to 13_*m* are electrically connected to pixels in the region 103.

Each of the subframe periods SF starts in accordance with falling of the potential of the pulse of the scan line driver circuit start pulse signal (GSP). The pulse width of the scan line driver circuit start pulse signal (GSP) is substantially the same as the pulse width of each of the first to fourth scan line driver circuit clock signals (GCK1 to GCK4). The falling of the potential of the pulse of the scan line driver circuit start pulse signal (GSP) is synchronized with rising of the potential of the pulse of the first scan line driver circuit clock signal (GCK1). The falling of the potential of the pulse of the scan line driver circuit start pulse signal (GSP) lags behind rising of the potential of the pulse of the first pulse width control signal (PWC1) by ⅙ of a cycle of the first pulse width control signal (PWC1).

The pulse output circuit illustrated in FIG. 3A is operated by the above signals in accordance with the timing chart in FIG. 3B. Accordingly, as illustrated in FIG. 4, the selection signals whose pulses are sequentially shifted are supplied to the scan lines 13_1 to 13_*k* provided in the region 101. Further, the phases of the pulses of the selection signals supplied to the scan lines 13_1 to 13_*k* are each shifted by a period corresponding to 3/2 of the pulse width. Note that the pulse width of each of the selection signals supplied to the scan lines 13_1 to **13_*k* is substantially the same as the pulse width of each of the first to sixth pulse width control signals (PWC1 to PWC6**).

As in the case of the region 101, selection signals whose pulses are sequentially shifted are supplied to the scan lines **13_*k*+1 to 13_2k provided in the region 102. Further, the phases of the pulses of the selection signals supplied to the scan lines 13_*k*+1 to 13_2k are each shifted by a period corresponding to 3/2 of the pulse width. Note that the pulse width of each of the selection signals supplied to the scan lines 13_*k*+1 to 13_2k is substantially the same as the pulse width of each of the first to sixth pulse width control signals (PWC1 to PWC6**).

As in the case of the region 101, selection signals whose pulses are sequentially shifted are supplied to the scan lines 13_2k+1 to **13_*m* provided in the region 103. Further, the phases of the pulses of the selection signals supplied to the scan lines 13_2k+1 to 13_*m* are each shifted by a period corresponding to 3/2 of the pulse width. Note that the pulse width of each of the selection signals supplied to the scan lines 13_2k+1 to 13_*m* is substantially the same as the pulse width of each of the first to sixth pulse width control signals (PWC1 to PWC6**).

The phases of the pulses of the selection signals supplied to the scan lines 13_1, **13_*k*+1, and 13**_2k+1 are sequentially shifted by a period corresponding to ½ of the pulse width.

<Configuration Example of Signal Line Driver Circuit>

Figure 5A:
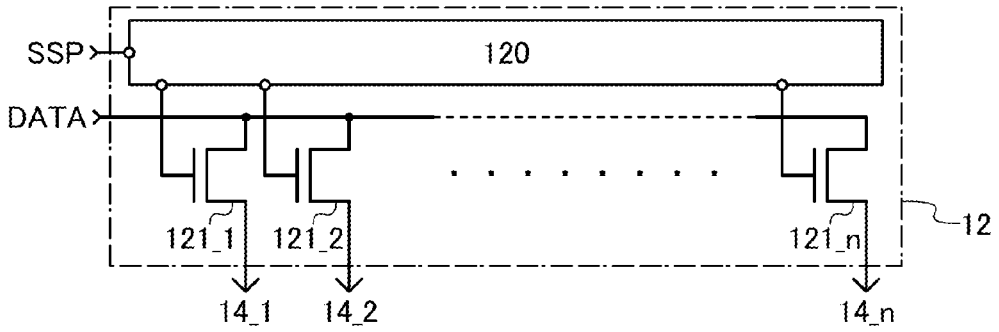
FIG. 5A illustrates a configuration example of a signal line driver circuit and FIG. 5B illustrates an example of a timing for supplying an image signal.

FIG. 5A illustrates a configuration example of the signal line driver circuit 12 included in the liquid crystal display device 100 illustrated in FIG. 1A. The signal line driver circuit 12 illustrated in FIG. 5A includes a shift register 120 having first to n-th output terminals, a wiring that supplies an image signal (DATA), and transistors 121_1 to **121_*n*. One of a source and a drain of the transistor 121_1 is electrically connected to the wiring that supplies the image signal (DATA). The other of the source and the drain of the transistor 121_1 is electrically connected to a signal line 14_1 provided in a first column in the pixel portion. A gate of the transistor 121_1 is electrically connected to the first output terminal of the shift register 120. One of a source and a drain of the transistor 121_*n* is electrically connected to the wiring that supplies the image signal (DATA). The other of the source and the drain of the transistor 121_*n* is electrically connected to a signal line 14_*n* provided in an n-th column in the pixel portion. A gate of the transistor 121_*n* is electrically connected to the n-th output terminal of the shift register 120**.

Note that the shift register 120 has a function of sequentially outputting a high-level potential from the first to n-th output terminals in each shift period in response to a signal line driver circuit start pulse (SSP). That is, the transistors 121_1 to **121_*n*** are sequentially turned on in each shift period.

Figure 5B:
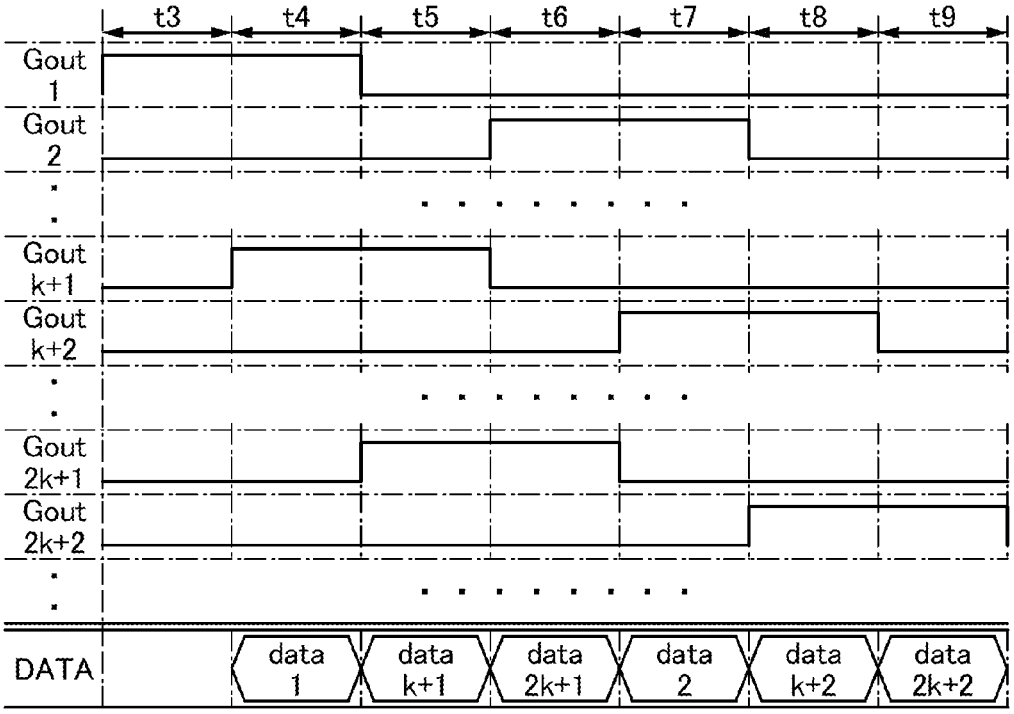

FIG. 5B illustrates an example of timing of an image signal supplied through the wiring that supplies the image signal (DATA). As illustrated in FIG. 5B, the wiring that supplies the image signal (DATA) supplies an image signal (data 1) for a pixel provided in the first row in the period t4, an image signal (data k+1) for a pixel provided in the (k+1)th row in the period t5, an image signal (data 2k+1) for a pixel provided in the (2k+1)th row in the period t6, and an image signal (data 2) for a pixel provided in the second row in the period t7. In this manner, the wiring that supplies the image signal (DATA) supplies image signals for pixels provided in given rows sequentially. When it is generalized, the wiring that supplies the image signal DATA sequentially supplies an image signal for a pixel provided in the s-th row (s is a natural number less than k), an image signal for a pixel provided in the (k+s)th row, an image signal for a pixel provided in the (2k+s)th row, and an image signal for a pixel provided in the (s+1)th row.

By the operation of the scan line driver circuit and the signal line driver circuit, image signals can be input to the pixels provided in three rows in the pixel portion in each shift period of the pulse output circuit included in the scan line driver circuit.

<Structure Example of Backlight>

Figure 6A:
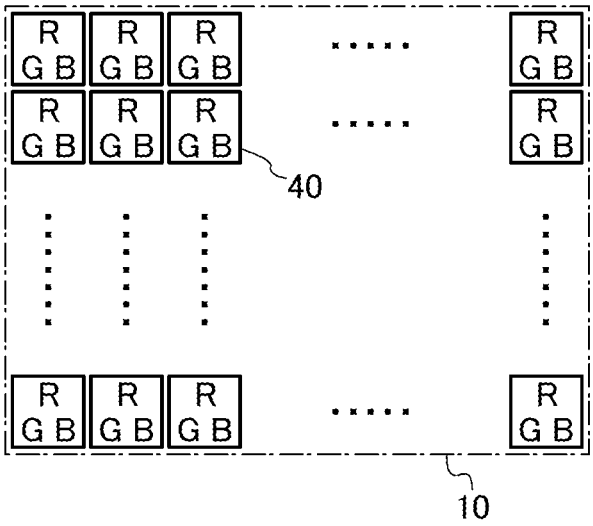
FIGS. 6A and 6B illustrate structure examples of a backlight.

FIG. 6A illustrates a structure example of a backlight provided behind the pixel portion 10 in the liquid crystal display device 100 illustrated in FIG. 1A. The backlight illustrated in FIGS. 6A and 6B includes a plurality of backlight units 40 each including light sources of three colors: red (also referred to as R) in a red wavelength band, green (also referred to as G) in a green wavelength band, and blue (also referred to as B) in a blue wavelength band. As the backlight unit 40, a light-emitting diode (LED) can be used, for example. The backlight units 40 including light sources of three colors can be formed with use of a red light-emitting diode, a green light-emitting diode, and a blue light-emitting diode.

Note that the plurality of backlight units 40 is arranged in matrix and lighting of the backlight units 40 can be controlled in each given region. Here, as a backlight for the plurality of pixels 15 provided in m rows by n columns, the backlight units 40 are provided in at least every t rows of scan lines (t is a natural number that satisfies k/N (N is a natural number)). N corresponds to the number of rows of the backlight units 40 in each region. Lighting of the backlight units 40 can be controlled independently.

Further, in the backlight unit 40, lighting of the light sources of the three colors R, G, and B can be controlled independently. In other words, in the backlight unit 40, when the light source of any one of R, G, and B is lit, the pixel portion 10 can be irradiated with light of any one of R, G, and B.

As an example, in this embodiment, N is 4, four rows of the backlight units 40 are provided in each region, and one row of the backlight units 40 function as light sources of t rows of the pixels 15.

Note that the pixel portion 10 is divided into three regions in this embodiment. When m is not a multiple of 3, the regions do not have the same number of rows of the backlight units 40 in some cases. The number of rows of the backlight units 40 is not necessarily the same between the regions and thus the number of rows of the backlight units 40 in each region may be determined on the basis of the number of rows of the pixels 15, as appropriate.

The emission intensity (luminance) of the backlight unit 40 observed through the pixel 15 is determined depending on the emission intensity of the backlight unit 40 placed immediately under the pixel 15. Actually, however, light including light diffused from an adjacent backlight unit 40 is observed.

Therefore, in the case where a region of the pixel portion 10 corresponds to a region where the backlight units 40 are provided as in FIG. 6A, even when all the backlight units 40 emit light at the same luminance and the same image signal is supplied to all the pixels 15, the luminance observed through the pixels 15 provided along the periphery of the pixel portion 10 is lower than the luminance observed through the pixels 15 provided interior to the pixels 15 provided along the periphery of the pixel portion 10.

Figure 6B:
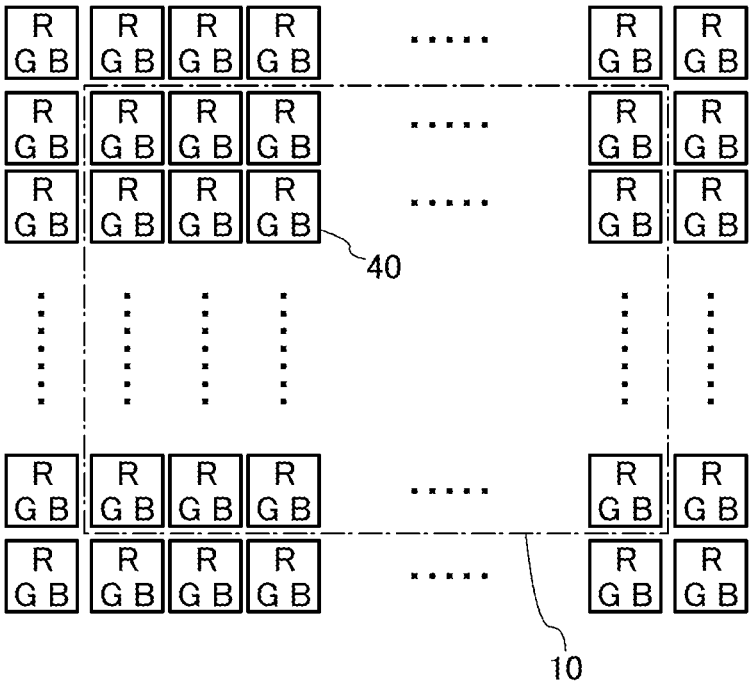

FIG. 6B illustrates an example where the backlight units 40 are also provided outside the pixel portion 10, that is, the region where the backlight units 40 are provided is larger than the region of the pixel portion 10. Since the backlight units 40 are also provided outside the pixel portion 10, the luminance observed through the pixels 15 provided along the periphery of the pixel portion 10 can be the same level as the luminance observed through the pixels 15 provided interior to the pixels 15 provided along the periphery of the pixel portion 10.

<Operation Example of Display Device>

Figure 7:
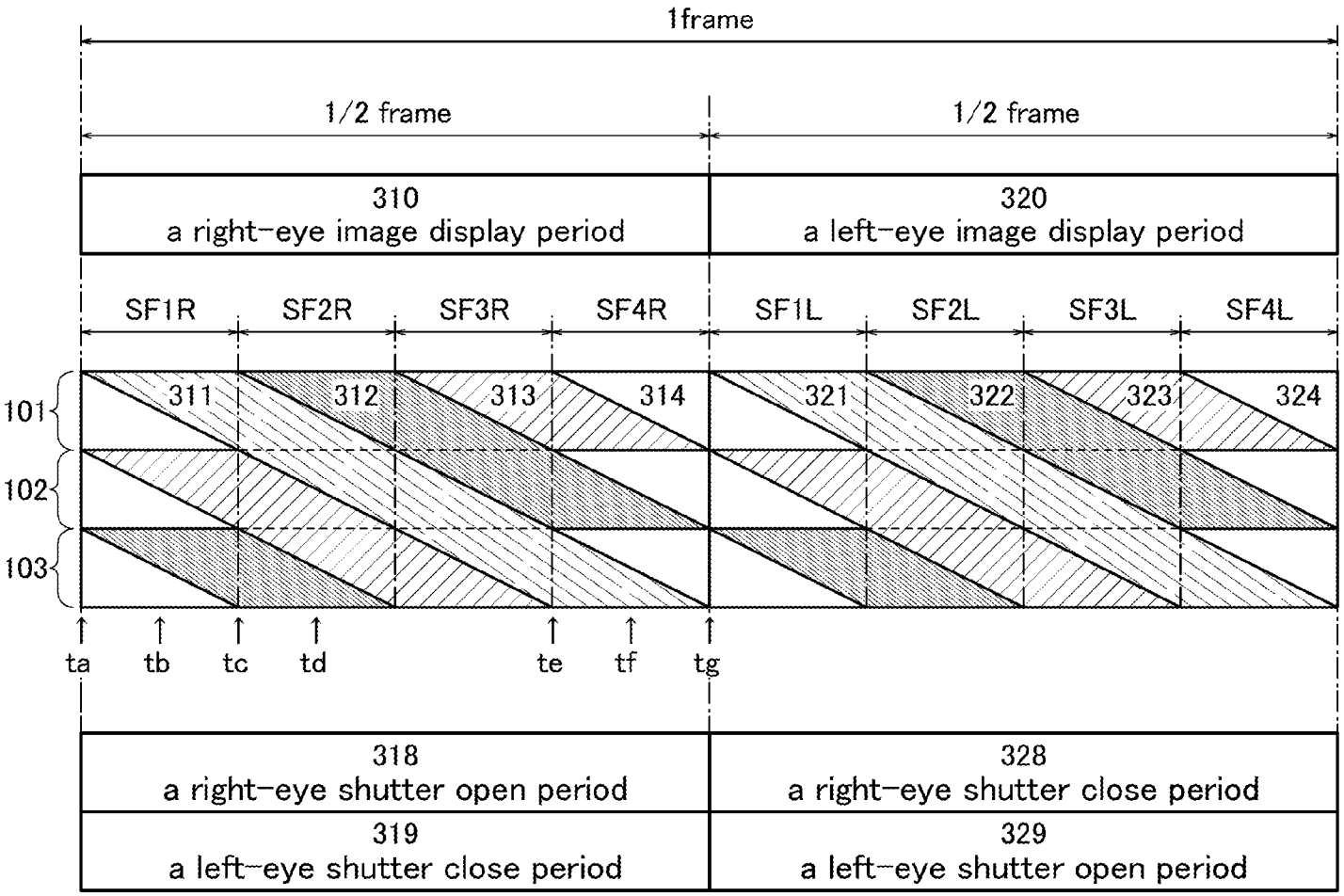
FIG. 7 illustrates an operation example of a liquid crystal display device.

Next, an operation example where the liquid crystal display device 100 shows a three-dimensional image is described with reference to FIG. 7, FIG. 8, FIG. 9, FIGS. 10A and 10B, and FIGS. 11A to 11G. FIG. 7 is a schematic view illustrating operation of performing three-dimensional display (stereoscopic display). As shown in FIG. 7, one frame period of a display device according to one embodiment of the present invention consists of a right-eye image display period 310 and a left-eye image display period 320.

The right-eye image display period 310 consists of a subframe period SF1R to a subframe period SF4R. The right-eye image display period 310 includes four periods, which are a first hue display period 311, a second hue display period 312, a third hue display period 313, and a black display period 314.

The left-eye image display period 320 consists of a subframe period SF1L to a subframe period SF4L. The left-eye image display period 320 includes four periods, which are a first hue display period 321, a second hue display period 322, a third hue display period 323, and a black display period 324.

In the first hue display period 311 and the first hue display period 321, a first hue signal is written into the pixel 15, and then light of the first hue is supplied by the corresponding backlight unit 40. In the second hue display period 312 and the second hue display period 322, a second hue signal is written into the pixel 15, and then light of the second hue is supplied by the corresponding backlight unit 40. In the third hue display period 313 and the third hue display period 323, a third hue signal is written into the pixel 15, and then light of the third hue is supplied by the corresponding backlight unit 40. In the black display period 314 and the black display period 324, supply of light from the backlight unit 40 is stopped (light is turned off).

In the first hue display period 311 to the third hue display period 313, and in the first hue display period 321 to the third hue display period 323, image signals (hue signals) corresponding to each hue are sequentially written into the pixel portion, and the hue of light supplied into the pixel portion is switched in the backlight unit 40. One image can be formed by writing image signals corresponding to all the hues in one frame period. Accordingly, in one frame period, the number of writings of the image signal to the pixel portion is more than one and is determined by the number of the hues of the lights supplied by the backlight.

In this embodiment, the first hue is red, the second hue is green, and the third hue is blue. That is, red is displayed in the first hue display period 311 and the first hue display period 321, green is displayed in the second hue display period 312 and the second hue display period 322, and blue is displayed in the third hue display period 313 and the third hue display period 323.

Figure 8:
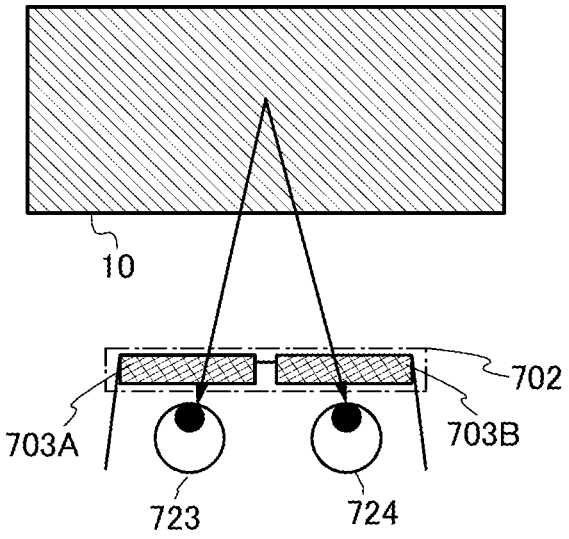
FIG. 8 illustrates an operation example of a liquid crystal display device.

An image displayed on the pixel portion 10 is seen with use of eyeglasses 702 including a left-eye shutter 703A and a right-eye shutter 703B as shown in FIG. 8; thus, a three-dimensional image can be seen.

In the right-eye image display period 310, the right-eye shutter 703B of the eyeglasses corresponding to a right eye 724 is opened (a right-eye shutter open period 318), and the left-eye shutter 703A of the eyeglasses corresponding to a left eye 723 is closed (a left-eye shutter close period 319); thus, light incident on the left eye 723 of a viewer is blocked. In the left-eye image display period 320, the left-eye shutter 703A of the eyeglasses corresponding to the left eye 723 is opened (a left-eye shutter open period 329), and the right-eye shutter 703B of the eyeglasses corresponding to the right eye 724 is closed (a right-eye shutter close period 328); thus, light incident on the right eye 724 of the viewer is blocked. In this manner, different images are perceived by the right eye 724 and the left eye 723 of the viewer and thus the viewer can perceive a two-dimensional image displayed on the pixel portion 10 as a pseudo three-dimensional image.

Further, opening and closing of the left-eye shutter 703A and the right-eye shutter 703B are performed at a time ta and a time tg shown in FIG. 7. At the time ta and the time tg, black is displayed on the whole pixel portion 10. Therefore, false recognition between the right-eye image and the left-eye image does not occur when opening and closing of the shutters are performed, so that three-dimensional images with high display quality can be seen.

Next, operation in which image signals are written into the regions 101 to 103 included in the pixel portion 10 and light of red (R), light of blue (B), and light of green (G) are supplied by the backlight units 40 is described with reference to FIG. 9, FIGS. 10A and 10B, and FIGS. 11A to 11G, using the right-eye image display period 310 as an example.

Figure 9:
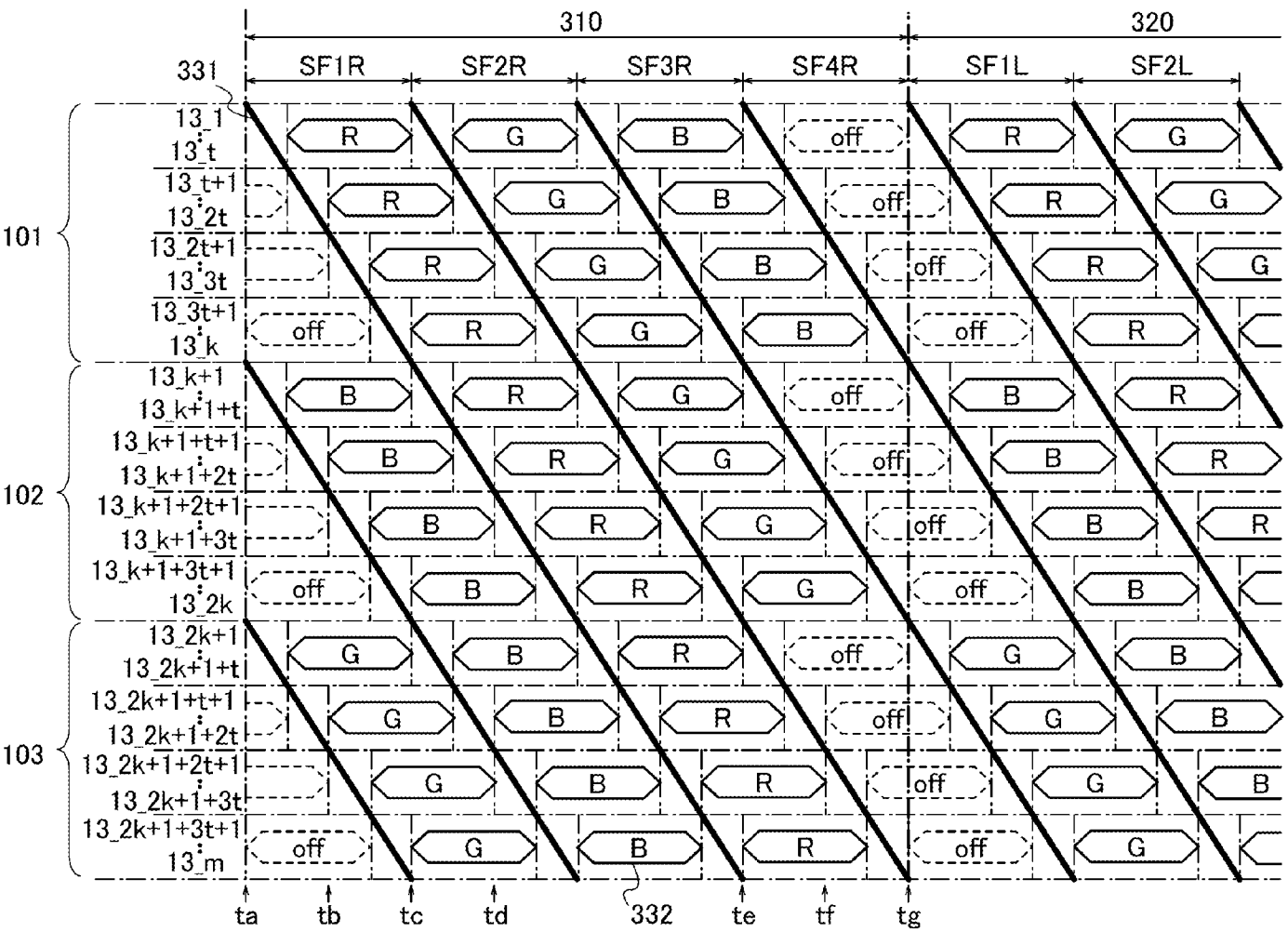
FIG. 9 illustrates an operation example of a liquid crystal display device.

FIG. 9 is a diagram for explaining operation of the regions 101 to 103 in the right-eye image display period 310 in FIG. 7 in detail. FIG. 9 shows relation between an image signal writing period 331 and a backlight lighting period 332 during the subframe period SF1R to the subframe period SF4R.

Figure 10A:
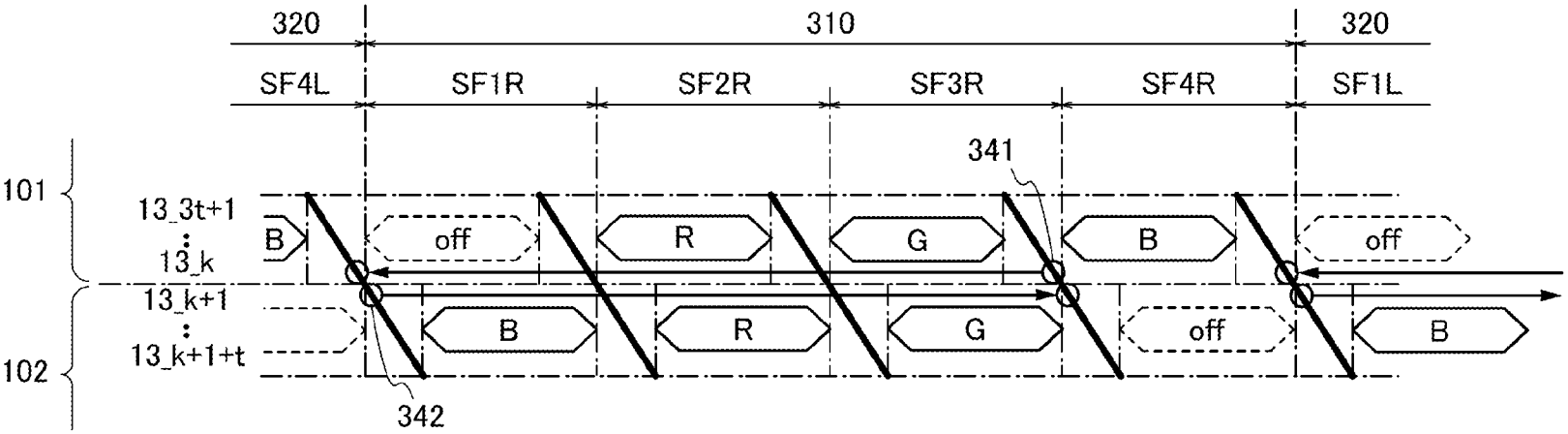
FIGS. 10A and 10B illustrate an operation example of a liquid crystal display device.
Figure 10B:
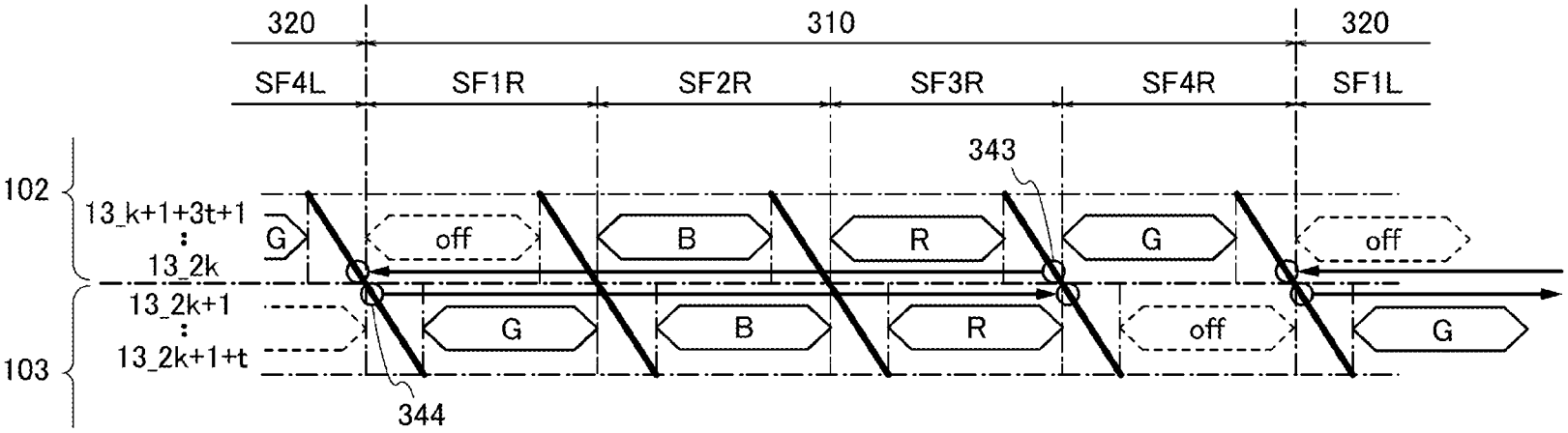

FIG. 10A is an enlarged view of a boundary portion between the region 101 and the region 102 in FIG. 9. FIG. 10B is an enlarged view of a boundary portion between the region 102 and the region 103 in FIG. 9.

FIGS. 11A to 11G show operation in which image signals are written into the regions 101 to 103 included in the pixel portion 10, and light of red (R), light of blue (B), and light of green (G) are supplied by the backlight units 40.

FIGS. 11A to 11G illustrate display states of the regions 101 to 103 at the time ta to the time tg shown in FIG. 7 and FIG. 9, respectively. At the time ta, the backlight units 40 of the regions 101 to 103 are turned off, so that black (K) display is performed on the whole pixel portion 10 (see FIG. 11A).

After the time ta, the scan lines 13_1 to 13_*k* are sequentially selected in the region 101, and an image signal of R is written into the pixels 15 electrically connected to the selected scan line 13. The image signal written into the pixel 15 is held until the pixel 15 is selected again. At this time, when writing for t rows is completed, light of R is supplied by the backlight units 40 corresponding to the t rows on which writing is performed.

In the region 102, the scan lines 13_*k*+1 to 13_2k are sequentially selected, and an image signal of B is written into the pixel 15 electrically connected to the selected scan line 13. The image signal written into the pixel 15 is held until the pixel 15 is selected again. At this time, when writing for t rows is completed, light of B is supplied by the backlight units 40 corresponding to the written t rows.

In the region 103, the scan lines 13_2k+1 to 13_*m* are sequentially selected, and an image signal of G is written into the pixel 15 electrically connected to the selected scan line 13. The image signal written into the pixel 15 is held until the pixel 15 is selected again. At this time, when writing for t rows is completed, light of G is supplied by the backlight units 40 corresponding to the written t rows.

Note that in this specification, the expression "an image signal is written into a pixel" or "an image signal of a pixel is rewritten" means that an image signal is supplied to a pixel, and after that the image signal supplied to the pixel is held until a new image signal is supplied to the pixel again unless otherwise specified.

Figure 11A:
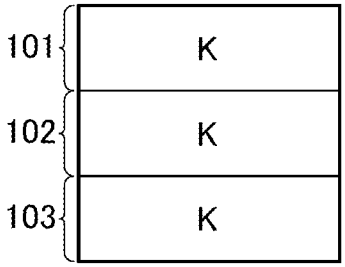
FIGS. 11A to 11G illustrate an operation example of a liquid crystal display device.
Figure 11B:
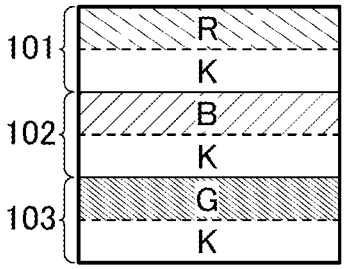

FIG. 11B illustrates a display state of the regions 101 to 103 at a time tb. At the time tb, the pixels 15 included in the regions 101 to 103 are in the middle of rewriting.

Figure 11C:
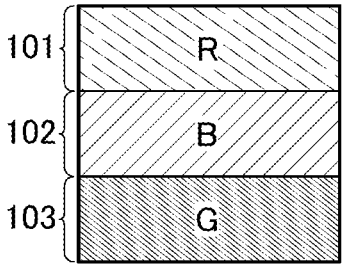

FIG. 11C illustrates a display state of the regions 101 to 103 at a time tc. At the time tc, an image signal of R has been written into all the pixels 15 included in the region 101, and light of R is supplied by the backlight units 40. Further, an image signal of B has been written into all the pixels 15 included in the region 102, and light of B is supplied by the backlight units 40; and an image signal of G has been written into all the pixels 15 included in the region 103, and light of G is supplied by the backlight units 40.

After the time tc, in the region 101, the backlight units 40 corresponding to the scan lines 13_1 to **13_*t* are turned off. Then, the scan lines 13_1 to 13_*t* are sequentially selected, and an image signal of G is written into a pixel electrically connected to the selected scan line 13. When writing for the scan line 13_*t* is completed, light of G is supplied by the backlight units 40 corresponding to the scan lines 13_1 to 13_*t***.

In the region 102, the backlight units 40 corresponding to the scan lines **13_*k*+1 to 13_*k*+1+t are turned off. Then, the scan lines 13_*k*+1 to 13_*k*+1+t are sequentially selected, and an image signal of R is written into a pixel electrically connected to the selected scan line 13. When writing for the scan line 13_*k*+1+t is completed, light of red (R) is supplied by the backlight units 40 corresponding to the scan lines 13_*k*+1 to 13_*k*+1+t**.

In the region 103, the backlight units 40 corresponding to the scan lines 13_2k+1 to 13_2k+1+t are turned off. Then, the scan lines 13_2k+1 to 13_2k+1+t are sequentially selected, and an image signal of B is written into a pixel electrically connected to the selected scan line 13. When writing for the scan line 13_2k+1+t is completed, light of blue (B) is supplied by the backlight units 40 corresponding to the scan lines 13_2k+1 to 13_2k+1+t.

Figure 11D:
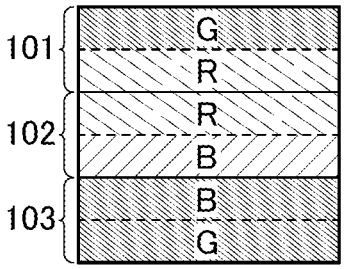

FIG. 11D illustrates a display state of the regions 101 to 103 at a time td. At the time td, the pixels 15 included in the regions 101 to 103 are in the middle of rewriting.

Figure 11E:
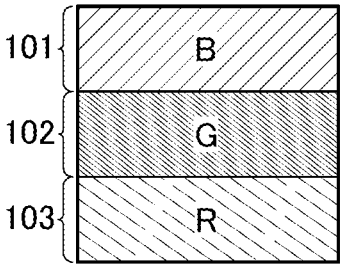

FIG. 11E illustrates a display state of the regions 101 to 103 at a time te. At the time te, an image signal of B has been written into all the pixels 15 included in the region 101, and light of B is supplied by the backlight units 40. Further, an image signal of G has been written into all the pixels 15 included in the region 102, and light of G is supplied by the backlight units 40; and an image signal of R has been written into all the pixels 15 included in the region 103, and light of R is supplied by the backlight units 40.

After the time te, in the region 101, the backlight units 40 corresponding to the scan lines 13_1 to **13_*t* are turned off. Then, the scan lines 13_1 to 13_*t* are sequentially selected, and an image signal of K is written into a pixel electrically connected to the selected scan line 13**.

In the region 102, the backlight units 40 corresponding to the scan lines **13_*k*+1 to 13_*k*+1+t are turned off. Then, the scan lines 13_*k*+1 to 13_*k*+1+t are sequentially selected, and an image signal of K is written into a pixel electrically connected to the selected scan line 13**.

In the region 103, the backlight units 40 corresponding to the scan lines 13_2k+1 to 13_2k+1+t are turned off. Then, the scan lines 13_2k+1 to 13_2k+1+t are sequentially selected, and an image signal of K is written into a pixel electrically connected to the selected scan line 13.

Figure 11F:
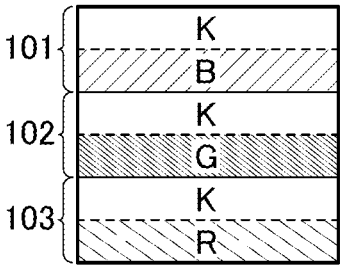

FIG. 11F illustrates a display state of the regions 101 to 103 at a time tf. At the time tf, the pixels 15 included in the regions 101 to 103 are in the middle of rewriting.

Figure 11G:
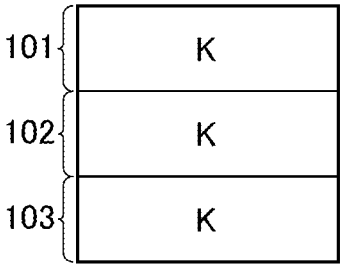

FIG. 11G illustrates a display state of the regions 101 to 103 at the time tg. At the time tg, all the backlight units 40 of the regions 101 to 103 are turned off, so that K display is performed on the whole pixel portion 10.

As described above, in the display device described in this embodiment, the pixel portion 10 is divided into plural regions, and an image can be displayed per backlight unit 40. In the conventional field-sequential method, it is necessary to light a backlight after an image signal is written into the whole pixel portion 10; in contrast, in the display device described in this embodiment, writing of an image signal and lighting of a backlight can be performed per region or backlight unit 40, which leads to shortening of a period during which the backlight is turned off. Therefore, a display device with high brightness and high display quality can be achieved. Further, decrease in display image quality due to color break can be suppressed. In addition, a display device with low power consumption can be realized.

As described in the structure example of a backlight, the luminance observed through the pixel 15 is determined depending on the sum of light of the backlight unit 40 placed immediately under the pixel 15 and diffusion light of an adjacent backlight unit 40. Thus, the luminance of the pixel 15, which is adjacent to a row where the backlight units 40 are turned off to perform black display, is decreased by diffusion light of the adjacent backlight unit 40.

In the subframe period SF1R, black is displayed on the pixels 15 electrically connected to the scan lines 13_3t+1 to **13_*k* in the region 101. When the backlight units 40 corresponding to the scan lines 13_3t+1 to 13_*k* are turned off, the luminance of the pixels 15 electrically connected to the scan line 13_*k*+1 in the region 102** is decreased.

In the subframe period SF4R, black is displayed on the pixels 15 electrically connected to the scan lines **13_*k*+1 to 13_*k*+1+t in the region 102. When the backlight units 40 corresponding to the scan lines 13_*k*+1 to 13_*k*+1+t in the region 102 are turned off, the luminance of the pixels 15 electrically connected to the scan line 13_*k* in the region 101** is decreased.

In the subframe period SF1R, black is displayed on the pixels 15 electrically connected to the scan lines **13_*k*+1+3t+1 to 13_2k in the region 102. When the backlight units 40 corresponding to the scan lines 13_*k*+1+3t+1 to 13_2k are turned off, the luminance of the pixels 15 electrically connected to the scan line 13_2k+1 in the region 103** is decreased.

In the subframe period SF4R, black is displayed on the pixels 15 electrically connected to the scan lines 13_2k+1 to 13_2k+1+t in the region 103. When the backlight units 40 corresponding to the scan lines 13_2k+1 to 13_2k+1+t in the region 103 are turned off, the luminance of the pixels 15 electrically connected to the scan line 13_2k in the region 102 is decreased.

Accordingly, in the boundary portion between the region 101 and the region 102 and the boundary portion between the region 102 and the region 103, decrease in luminance of R, G, or B occurs and thus accurate color reproduction cannot be performed, leading to decrease in display quality.

In view of the above, in the case where black is displayed on the pixels 15 electrically connected to the scan lines 13_3t+1 to 13_*k* in the region 101 in the subframe period SF1R, the backlight units 40 corresponding to the scan lines 13_3t+1 to 13_*k* in the region 101 are turned off in the subframe period SF4L just before the subframe period SF1R; and then, an image signal 341 for displaying blue on the pixels 15 electrically connected to the scan line 13_*k* in the subframe period SF4R is written into the pixels 15 electrically connected to the scan line 13_*k* (see FIG. 10A).

In this manner, in the black display period of the subframe period SF1R, image data of the subframe period SF4R for displaying blue is held in the pixels 15 electrically connected to the scan line 13_*k*. Accordingly, diffusion light of backlight units 40 on the adjacent region 102 side is observed through the pixels 15 electrically connected to the scan line 13_*k* in the black display period.

Increase in luminance of the pixel 15 electrically connected to the scan line 13_*k* in the black display period (the subframe period SF1R) and decrease in luminance of the pixel 15 electrically connected to the scan line 13_*k* in a blue display period (the subframe period SF4R) are observed substantially at the same time by a viewer. At this time, the image data written into the pixel 15 electrically connected to the scan line 13_*k* in the subframe period SF1R is the same as that in the subframe period SF4R. Therefore, the increase in luminance and the decrease in luminance compensate for each other and thus accurate color reproduction can be performed.

Note that this embodiment shows the case where the decrease in luminance in the boundary portion occurs in one scan line 13; however, the decrease in luminance may occur in plural scan lines 13 depending on the structure, the arrangement, and the emission intensity of the backlight units 40. Therefore, image data for displaying a hue may be held in the pixels 15 electrically connected to plural scan lines 13 during the black display period.

For example, an image signal for displaying blue on the pixels 15 electrically connected to the scan lines 13_3t+1 to 13_*k* in the subframe period SF4R may be held in the pixels 15 electrically connected to the scan lines 13_3t+1 to 13_*k*, on which black is displayed in the subframe period SF1R. Note that the image signal written into the pixels 15 electrically connected to the scan lines 13_3t+1 to 13_*k* in the black display period is written into the pixels 15 which are the same as the pixels 15 into which the image signal for displaying blue is written in the subframe period SF4R.

Further, when black is displayed on the pixels 15 electrically connected to the scan lines 13_*k*+1 to 13_*k*+1+t of the region 102 in the subframe period SF4R, an image signal 342 for displaying blue on the pixels 15 electrically connected to the scan line 13_*k*+1 in the subframe period SF1R is written into the pixels 15 electrically connected to the scan line 13_*k*+1 (see FIG. 10A).

In the case where black is displayed on the pixels 15 electrically connected to the scan lines 13_*k*+1+3t+1 to 13_2k in the region 102 in the subframe period SF1R, the backlight units 40 corresponding to the scan lines 13_*k*+1+3t+1 to 13_2k are turned off in the subframe period SF4L just before the subframe period SF1R; and then, an image signal 343 for displaying green on the pixels 15 electrically connected to the scan line 13_2k in the subframe period SF4R is written into the pixels 15 electrically connected to the scan line 13_2k. In this manner, in the black display period of the subframe period SF1R, image data of the subframe period SF4R for displaying green is held in the pixels 15 electrically connected to the scan line 13_2k (see FIG. 10B).

Further, when black is displayed on the pixels 15 electrically connected to the scan lines 13_2k+1 to 13_2k+1+t of the region 103 in the subframe period SF4R, an image signal 344 for displaying green on the pixels 15 electrically connected to the scan line 13_2k+1 in the subframe period SF1R is written into the pixels 15 electrically connected to the scan line 13_2k+1 (see FIG. 10B).

Writing image data into the pixels 15 in the black display period as described above can achieve a display device with high color reproducibility and high display quality.

Since a color filter is not used in the liquid crystal display device 100 in this embodiment, favorable three-dimensional images can be displayed without decreasing resolution. In addition, since a color filter is not used, absorption of light of a backlight by a color filter does not occur. Therefore, a liquid crystal display device with high brightness and high display quality can be achieved. Further, a liquid crystal display device with low power consumption can be realized.

Note that although this embodiment shows an example in which red is displayed in the first hue display period 311, green is displayed in the second hue display period 312, and blue is displayed in the third hue display period 313, one embodiment of the present invention is not limited thereto. In the first hue display period 311 to the third hue display period 313, any hue can be displayed. For example, blue may be displayed in the first hue display period 311, red may be displayed in the second hue display period 312, and green may be displayed in the third hue display period 313.

Further, hues used for the first hue display period 311 to the third hue display period 313 may be a combination of cyan, magenta, and yellow, instead of a combination of red, green, and blue. Alternatively, the number of hue display periods may be increased and red, green, blue, cyan, magenta, and yellow may be used in an appropriate combination. Alternatively, the same hue may be employed during the first hue display period 311 to the third hue display period 313 so as to display a single color. Note that the same applies to the first hue display period 321 to the third hue display period 323 in the left-eye image display period 320.

A hue displayed in the first hue display period 311 to the third hue display period 313 and a hue displayed in the first hue display period 321 to the third hue display period 323 may differ between the right-eye image display period 310 and the left-eye image display period 320, or may be changed in every frame. For example, red may be displayed in the first hue display period 311 of the right-eye image display period 310, and green may be displayed in the first hue display period 321 of the left-eye image display period 320. By employing such a display manner, decrease in display image quality due to color break can be further suppressed, leading to a display device with high display quality.

Further, in the liquid crystal display device 100 described in this embodiment, two-dimensional display can be performed. In the case of performing two-dimensional display, it is not necessary to perceive display in the right-eye image display period 310 and display in the left-eye image display period 320 separately, so that images can be observed without the eyeglasses 702.

Further, one frame is not divided into the right-eye image display period 310 and the left-eye image display period 320, so that a frame period can be half as compared with that in the case of three-dimensional display; thus, a display device with high brightness and low power consumption can be achieved. In addition, black is displayed on the entire surface of the pixel portion 10 (black insertion) after every frame; therefore, residual images in displaying a moving image can be reduced.

This embodiment can be implemented in appropriate combination with the structures described in the other embodiments.

Embodiment 2

In this embodiment, an example of a transistor that can be applied to a liquid crystal display device disclosed in this specification is described. There is no particular limitation on the structure of the transistor that can be applied to the liquid crystal display device disclosed in this specification. For example, a staggered transistor, a planar transistor, or the like with a top-gate structure in which a gate electrode is provided over an oxide semiconductor layer with a gate insulating layer provided therebetween or a bottom-gate structure in which a gate electrode is provided below an oxide semiconductor layer with a gate insulating layer provided therebetween can be used. Further, the transistor may have a single-gate structure including one channel formation region, a double-gate structure including two channel formation regions, or a triple-gate structure including three channel formation regions. Furthermore, the transistor may have a dual-gate structure including two gate electrodes placed over and below a channel region with a gate insulating layer provided therebetween. Note that FIGS. 12A to 12D illustrate examples of cross-sectional structures of transistors.

Figure 12A:
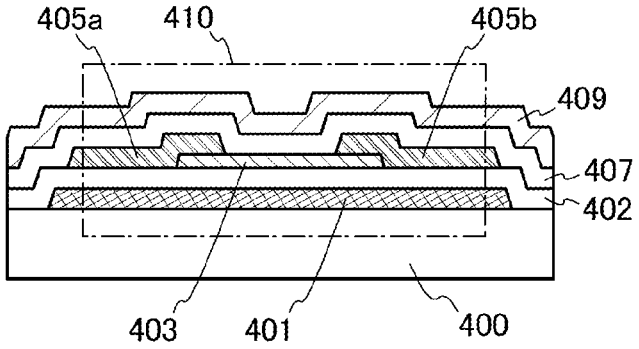
FIGS. 12A to 12D illustrate structure examples of a transistor in cross section.

A transistor 410 illustrated in FIG. 12A is a kind of bottom-gate transistor and is also referred to as an inverted-staggered transistor.

The transistor 410 includes, over a substrate 400 having an insulating surface, a gate electrode 401, a gate insulating layer 402, a semiconductor layer 403, a source electrode 405*a*, and a drain electrode 405*b*. In addition, an insulating layer 407 which covers the transistor 410 and is stacked over the semiconductor layer 403 is provided. A protective insulating layer 409 is formed over the insulating layer 407.

Figure 12B:
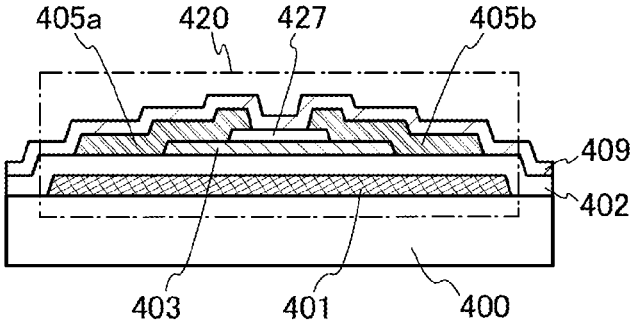

A transistor 420 illustrated in FIG. 12B is a kind of bottom-gate transistor referred to as a channel-protective transistor (also referred to as a channel-stop transistor) and is also referred to as an inverted-staggered transistor.

The transistor 420 includes, over the substrate 400 having an insulating surface, the gate electrode 401, the gate insulating layer 402, the semiconductor layer 403, an insulating layer 427 which functions as a channel protective layer for covering a channel formation region of the semiconductor layer 403, the source electrode 405*a*, and the drain electrode 405*b*. Further, the protective insulating layer 409 is formed so as to cover the transistor 420.

Figure 12C:
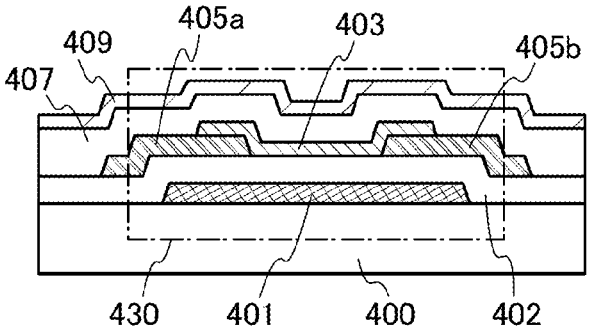

A transistor 430 illustrated in FIG. 12C is a bottom-gate transistor and includes, over the substrate 400 having an insulating surface, the gate electrode 401, the gate insulating layer 402, the source electrode 405*a*, the drain electrode 405*b*, and the oxide semiconductor layer 403. The insulating layer 407 which covers the transistor 430 and is in contact with the semiconductor layer 403 is provided. The protective insulating layer 409 is formed over the insulating layer 407.

In the transistor 430, the gate insulating layer 402 is provided over and in contact with the substrate 400 and the gate electrode 401, and the source electrode 405*a* and the drain electrode 405*b* are provided over and in contact with the gate insulating layer 402. Further, the semiconductor layer 403 is provided over the gate insulating layer 402, the source electrode 405*a*, and the drain electrode 405*b*.

Figure 12D:
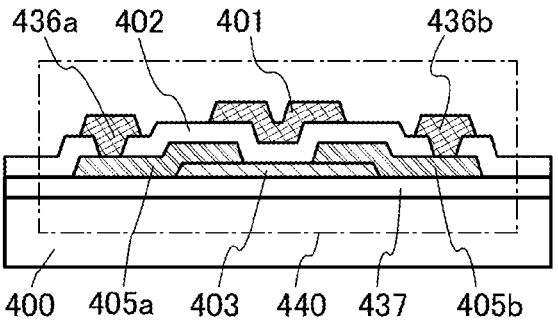

A transistor 440 illustrated in FIG. 12D is a kind of top-gate transistor. The transistor 440 includes, over the substrate 400 having an insulating surface, an insulating layer 437, the oxide semiconductor layer 403, the source electrode 405*a*, the drain electrode 405*b*, the gate insulating layer 402, and the gate electrode 401. A wiring layer 436*a* and a wiring layer 436*b* are formed in contact with and electrically connected to the source electrode 405*a* and the drain electrode 405*b*, respectively.

A semiconductor material used for the semiconductor layer 403 is not limited to a non-single-crystal semiconductor typified by amorphous silicon, microcrystalline silicon, or polysilicon, and a known semiconductor material, for example, a single-crystal semiconductor, a compound semiconductor such as GaAs or CdTe, an oxide semiconductor such as ZnO or InGaZnO, or an organic semiconductor can be used.

Although there is no particular limitation on a substrate that can be used as the substrate 400 having an insulating surface, a glass substrate formed using barium borosilicate glass, aluminoborosilicate glass, or the like is used.

In the bottom-gate structure transistors 410, 420, and 430, an insulating layer serving as a base layer may be provided between the substrate and the gate electrode. The base layer has a function of preventing diffusion of an impurity element from the substrate 400, and can be formed to have a single-layer structure or a layered structure of one or more insulating layers selected from a silicon nitride layer, a silicon oxide layer, a silicon nitride oxide layer, and a silicon oxynitride layer.

When a halogen element such as chlorine or fluorine is contained in the insulating layer to be a base layer, a function of preventing diffusion of an impurity element from the substrate 400 can be further improved. The concentration of a halogen element contained in the insulating layer to be a base layer is measured by secondary ion mass spectrometry (SIMS) and its peak is preferably greater than or equal to $1\times10^{15}/cm^3$ and less than or equal to $1\times10^{20}/cm^3$.

Gallium oxide may be used for the insulating layer to be a base layer. Alternatively, a stacked-layer structure of a gallium oxide layer and the above insulating layer may be used for the insulating layer to be a base layer. Gallium oxide is a material which is hardly charged; therefore, variation in threshold voltage due to charge buildup of the insulating layer can be suppressed.

The gate electrode 401 can be formed to have a single-layer structure or a layered structure of a metal material such as aluminum (Al), chromium (Cr), copper (Cu), tantalum (Ta), titanium (Ti), molybdenum (Mo), tungsten (W), neodymium (Nd), or scandium (Sc); an alloy material which contains any of these elements as its main component; a metal nitride (i.e., titanium nitride, molybdenum nitride, or tungsten nitride) which contains any of these elements; or the like.

Since the conductive layer is formed into a wiring, it is preferable to use Al or Cu which is a low-resistance material. The used of Al or Cu can reduce signal delay, so that higher image quality can be realized. Al has low heat resistance; therefore, defects due to a hillock, a whisker, or migration tend to be caused. In order to prevent migration of Al, a layered structure including Al and a metal material having a higher melting point than Al, such as Mo, Ti, or W, is preferably employed.

Also in the case where Cu is used for the conductive layer, in order to prevent a defect due to migration and diffusion of Cu elements, a layered structure including Cu and a metal material having a higher melting point than Cu, such as Mo, Ti, or W, is preferably employed.

The gate insulating layer 402 can be formed to have a single-layer structure or a layered structure of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, or a hafnium oxide layer by plasma-enhanced CVD, sputtering, or the like. For example, a 200-nm-thick gate insulating layer is formed in such a manner that a silicon nitride layer ($SiN_y$ (y>0)) with a thickness of 50 nm to 200 nm is formed as a first gate insulating layer by plasma-enhanced CVD and a silicon oxide layer ($SiO_x$ (x>0)) with a thickness of 5 nm to 300 nm is formed as a second gate insulating layer over the first gate insulating layer.

The conductive layer for forming the source electrode 405*a* and the drain electrode 405*b* can be formed using a material and a method similar to those of the gate electrode 401. Further, a material which is similar to the material of the source electrode 405*a* and the drain electrode 405*b* can be used for a conductive layer used for the wiring layer 436*a* and the wiring layer 436*b* which are connected to the source electrode 405*a* and the drain electrode 405*b*, respectively.

Alternatively, the conductive film to be the source electrode 405*a* and the drain electrode 405*b* (including a wiring layer formed using the same layer as source electrode 405*a* and the drain electrode 405*b*) may be formed using a conductive metal oxide. As the conductive metal oxide, indium oxide ($In_2O_3$), tin oxide ($SnO_2$), zinc oxide (ZnO), indium oxide-tin oxide alloy ($In_2O_3$—$SnO_2$; abbreviated to ITO), indium oxide-zinc oxide alloy ($In_2O_3$—ZnO), or any of these metal oxide materials in which silicon oxide is contained can be used. Alternatively, a material formed of 1 to 10 graphene sheets (a graphene sheet corresponds to a single layer of graphite) may be used.

As the insulating layers 407 and 427 provided over the semiconductor layer 403, and the insulating layer 437 provided below the semiconductor layer, an inorganic insulating film of a material such as a silicon oxide, a silicon oxynitride, an aluminum oxide, an aluminum oxynitride, or the like can be typically used.

For the protective insulating layer 409 provided over the semiconductor layer 403, an inorganic insulating film of a material such as a silicon nitride, an aluminum nitride, a silicon nitride oxide, or an aluminum nitride oxide can be used.

Further, a planarization insulating layer may be formed over the protective insulating layer 409 so that surface roughness due to the transistor is reduced. For the planarization insulating layer, an organic material such as polyimide, an acrylic resin, a benzocyclobutene-based resin, or an epoxy resin can be used. Other than such organic materials, a low-dielectric constant material (a low-k material), a siloxane-based resin, phosphosilicate glass (PSG), borophosphosilicate glass (BPSG), or the like can be used. Note that the planarization insulating layer may be formed by a stack of a plurality of insulating layers formed using these materials.

This embodiment can be implemented in appropriate combination with the structures described in the other embodiments.

Embodiment 3

In this embodiment, an example of a panel of a liquid crystal display device which is one embodiment of the present invention is described with reference to FIGS. 13A and 13B. Further, a structure example of a liquid crystal display device which is one embodiment of the present invention is described with reference to FIG. 14.

Figure 13A:
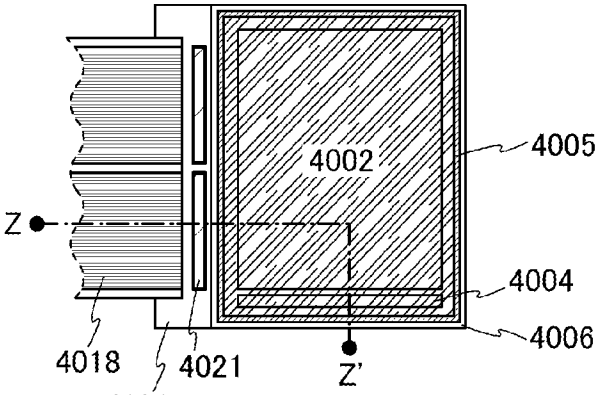
FIGS. 13A and 13B illustrate an example of a panel of a liquid crystal display device.
Figure 13B:
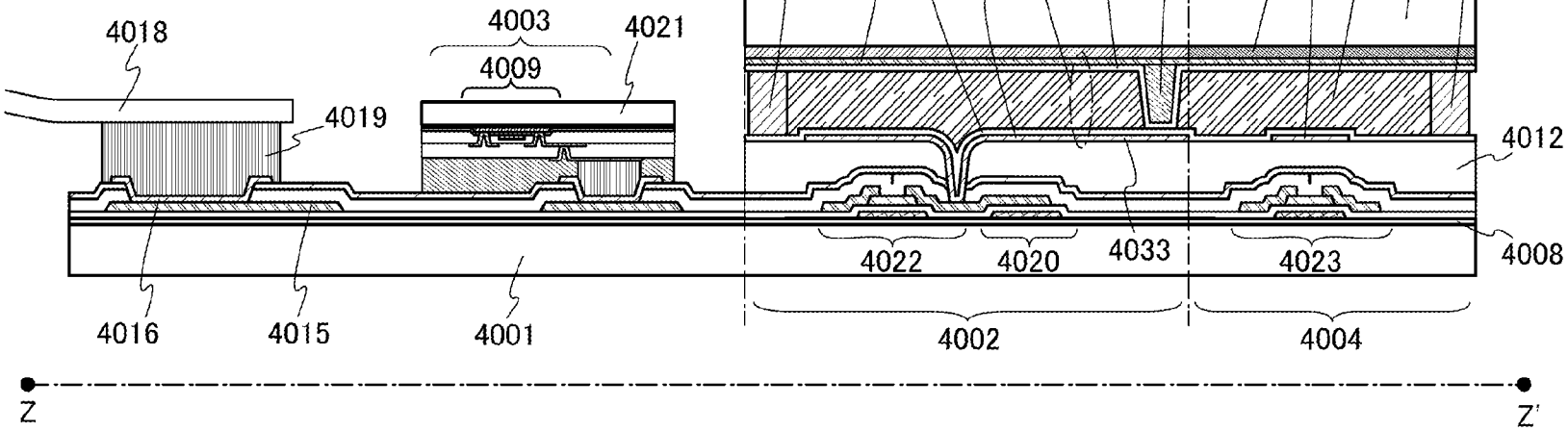

FIG. 13A is a top view of a panel in which a substrate 4001 is attached to a counter substrate 4006 with a sealant 4005, and FIG. 13B is a cross-sectional view along dashed line Z-Z' in FIG. 13A.

The sealant 4005 is provided so as to surround a pixel portion 4002 and a scan line driver circuit 4004 provided over the substrate 4001. In addition, the counter substrate 4006 is provided over the pixel portion 4002 and the scan line driver circuit 4004. Thus, the pixel portion 4002 and the scan line driver circuit 4004 are sealed together with a liquid crystal 4007 by the substrate 4001, the sealant 4005, and the counter substrate 4006.

A substrate 4021 provided with a signal line driver circuit 4003 is mounted in a region which is different from the region surrounded by the sealant 4005 over the substrate 4001. In FIG. 13B, a transistor 4009 included in the signal line driver circuit 4003 is illustrated.

A plurality of transistors over a base layer 4008 is included in the pixel portion 4002 and the scan line driver circuit 4004 which are provided over the substrate 4001. In FIG. 13B, a transistor 4022 and a capacitor 4020 which are included in the pixel portion 4002 are illustrated. A blocking layer 4040 provided for the counter substrate 4006 overlaps with a transistor 4023 included in the scan line driver circuit 4004. By blocking light to the transistor 4023, deterioration of a semiconductor layer 403 in each transistor due to light is prevented; thus, deterioration of characteristics of the transistor 4023, such as a shift of the threshold voltage, can be prevented. As the transistors 4022 and 4023, the transistors described in Embodiment 2 can be used.

A back gate electrode 4032 is formed over the transistor 4023 with a planarization insulating layer 4012 interposed therebetween. Note that the back gate electrode is positioned so that the channel formation region of the semiconductor layer 403 is interposed between the gate electrode and the back gate electrode. The back gate electrode is formed using a conductive layer and can function in a manner similar to that of the gate electrode. By changing a potential of the back gate electrode, the threshold voltage of the transistor can be changed. The back gate electrode 4032 illustrated in FIG. 13B is formed using a conductive layer the same as a conductive layer of a pixel electrode 4030.

The pixel electrode 4030 included in a liquid crystal element 4011 is formed using a light-transmitting conductive material, and is electrically connected to the transistor 4022 and the capacitor 4020. As the light-transmitting conductive material, indium oxide ($In_2O_3$), tin oxide ($SnO_2$), zinc oxide (ZnO), indium oxide-tin oxide alloy (abbreviated to $In_2O_3$—$SnO_2$), indium oxide-zinc oxide alloy ($In_2O_3$—ZnO), or any of these metal oxide materials in which silicon oxide is contained can be used. Alternatively, a material formed of 1 to 10 graphene sheets (a graphene sheet corresponds to a single layer of graphite) may be used.

A counter electrode 4031 of the liquid crystal element 4011 is provided for the counter substrate 4006. A portion where the pixel electrode 4030, the counter electrode 4031, and the liquid crystal 4007 overlap with each other corresponds to the liquid crystal element 4011. The pixel electrode 4030 overlaps with the liquid crystal 4007 with an alignment layer 4034 interposed therebetween. The counter electrode 4031 overlaps with the liquid crystal 4007 with an alignment layer 4035 interposed therebetween.

As examples of a liquid crystal material used for the liquid crystal 4007, the following can be given: a nematic liquid crystal, a cholesteric liquid crystal, a smectic liquid crystal, a discotic liquid crystal, a thermotropic liquid crystal, a lyotropic liquid crystal, a low-molecular liquid crystal, a polymer dispersed liquid crystal (PDLC), a ferroelectric liquid crystal, an anti-ferroelectric liquid crystal, a main-chain liquid crystal, a side-chain high-molecular liquid crystal, a banana-shaped liquid crystal, and the like.

Alternatively, liquid crystal exhibiting a blue phase for which an alignment layer is unnecessary may be used. A blue phase is one of liquid crystal phases, which is generated just before a cholesteric phase changes into an isotropic phase while temperature of cholesteric liquid crystal is increased. Since the blue phase is only generated within a narrow range of temperature, a chiral agent or an ultraviolet curable resin is added so that the temperature range is improved. The liquid crystal composition which includes a liquid crystal exhibiting a blue phase and a chiral agent is preferable because it has optical isotropy, which makes the alignment process unneeded, and has a small viewing angle dependence. Further, the liquid crystal exhibiting a blue phase has a short response time of greater than or equal to 10 μsec. and less than or equal to 100 μsec. Therefore, the liquid crystal exhibiting a blue phase is preferably used for a field sequential method which needs high speed operation.

Moreover, the following methods can be used for driving the liquid crystal, for example: a TN (twisted nematic) mode, an STN (super twisted nematic) mode, a VA (vertical alignment) mode, an MVA (multi-domain vertical alignment) mode, an IPS (in-plane-switching) mode, an OCB (optically compensated birefringence) mode, an ECB (electrically controlled birefringence) mode, an FLC (ferroelectric liquid crystal) mode, an AFLC (anti-ferroelectric liquid crystal) mode, a PDLC (polymer dispersed liquid crystal) mode, a PNLC (polymer network liquid crystal) mode, and a guest-host mode.

A spacer 4036 is a columnar spacer which is formed over the counter substrate 4006 using an insulating layer. The spacer 4036 is provided to control a distance (a cell gap) between the pixel electrode 4030 and the counter electrode 4031. FIG. 13B shows the case where the spacer 4036 is formed by patterning of an insulating layer; alternatively, a spherical spacer may be used.

A variety of signals and potentials are supplied to the signal line driver circuit 4003, the scan line driver circuit 4004, and the pixel portion 4002 from a connection terminal 4016 through wiring 4015. The connection terminal 4016 is electrically connected to a terminal of a FPC 4018 via an anisotropic conductive layer 4019.

Note that any of the substrate 4001, the counter substrate 4006, and the substrate 4021 can be formed using glass, ceramics, or plastics. Plastics include in its category, a fiberglass-reinforced plastic (FRP) plate, a polyvinyl fluoride (PVF) film, a polyester film, an acrylic resin film, and the like.

Figure 14:
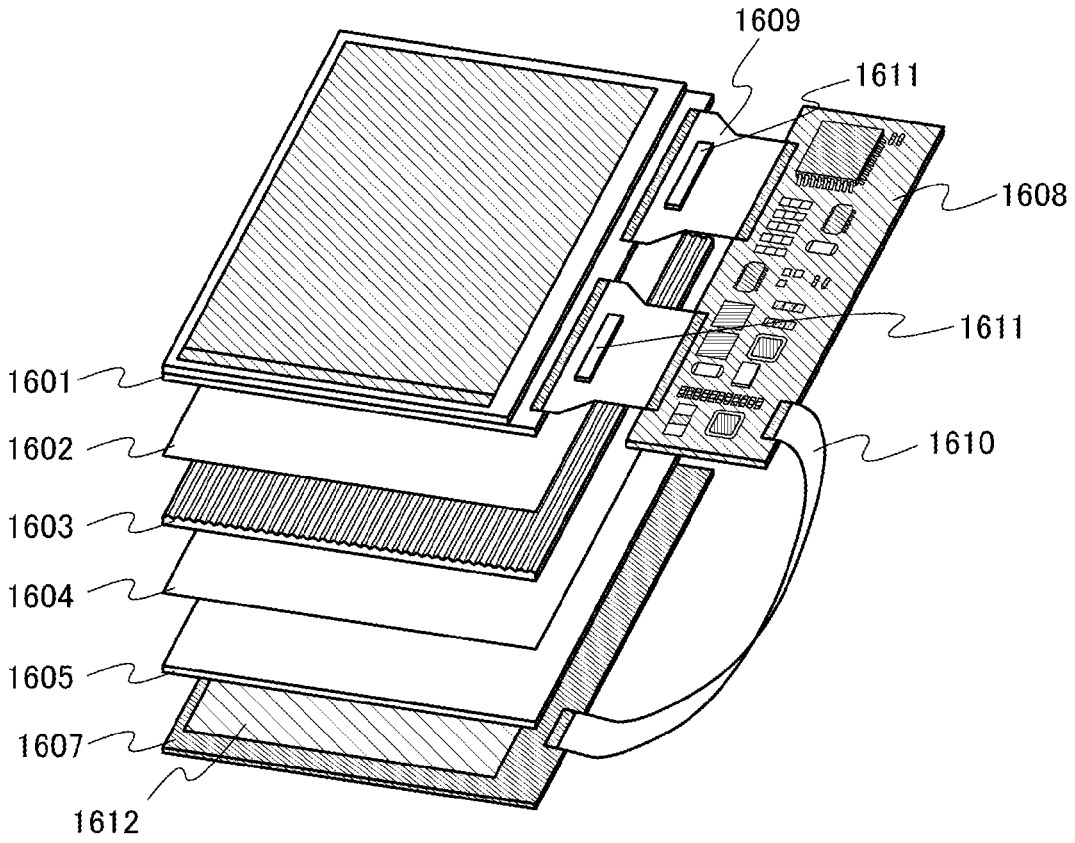
FIG. 14 illustrates a structure example of a liquid crystal display device.

FIG. 14 is a perspective view illustrating a structure example of a liquid crystal display device which is one embodiment of the present invention. The liquid crystal display device illustrated in FIG. 14 includes a panel 1601 including a pixel portion, a first diffusion plate 1602, a prism sheet 1603, a second diffusion plate 1604, a light guide plate 1605, a backlight panel 1607, a circuit board 1608, and a substrate 1611 provided with a signal line driver circuit.

The panel 1601, the first diffusion plate 1602, the prism sheet 1603, the second diffusion plate 1604, the light guide plate 1605, and the backlight panel 1607 are sequentially stacked. The backlight panel 1607 has a backlight 1612 including a plurality of backlight units 40 arranged in matrix. Light from the backlight 1612 that is diffused into the light guide plate 1605 is delivered to the panel 1601 through the first diffusion plate 1602, the prism sheet 1603, and the second diffusion plate 1604.

Although the first diffusion plate 1602 and the second diffusion plate 1604 are used in this embodiment, the number of diffusion plates is not limited to two; the number of diffusion plates may be one, or may be three or more. The diffusion plate is provided between the light guide plate 1605 and the panel 1601. The diffusion plate may be provided only on the side closer to the panel 1601 than the prism sheet 1603, or may be provided only on the side closer to the light guide plate 1605 than the prism sheet 1603.

Further, the shape of the cross section of the prism sheet 1603 which is illustrated in FIG. 14 is not limited to a serrate shape; the cross section can have any shape with which light from the light guide plate 1605 can be gathered to the panel 1601 side.

The circuit board 1608 is provided with a circuit which generates various signals input to the panel 1601, a circuit which processes the signals, or the like. In this embodiment, the circuit board 1608 is electrically connected to the panel 1601 via a COF tape 1609. In addition, the substrate 1611 provided with the signal line driver circuit is electrically connected to the COF tape 1609 by a chip on film (COF) method.

This embodiment illustrates an example in which the circuit board 1608 is provided with a control circuit which controls driving of the backlight 1612 and the control circuit is electrically connected to the backlight panel 1607 via an FPC 1610. The control circuit may be formed over the panel 1601. In that case, the panel 1601 may be electrically connected to the backlight panel 1607 via an FPC or the like.

This embodiment can be implemented in appropriate combination with the structures described in the other embodiments.

Embodiment 4

In this embodiment, structure examples of electronic devices each provided with the liquid crystal display device of the above embodiment are described as modes of semiconductor devices.

Structure examples of electronic devices of this embodiment are described with reference to FIGS. 15A to 15D. FIGS. 15A to 15D are schematic views illustrating of structure examples of electronic devices.

Figure 15A:
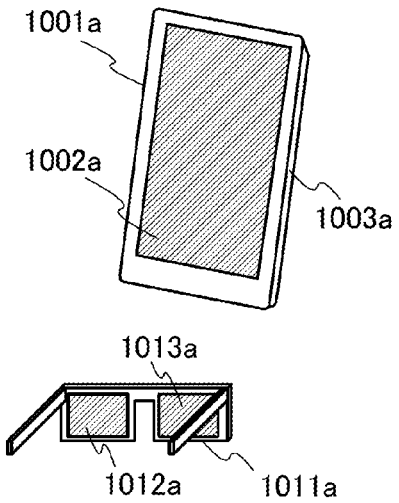
FIGS. 15A to 15D illustrate structure examples of electronic devices.

An electronic device illustrated in FIG. 15A is an example of a portable information terminal. The portable information terminal in FIG. 15A includes a housing 1001*a* and a display portion 1002*a* provided in the housing 1001*a*. The liquid crystal display device disclosed in the above embodiment can provide light of a backlight efficiently because it does not need a color filter. Therefore, by employing the liquid crystal display device disclosed in the above embodiment for the display portion 1002*a*, a portable information terminal with low power consumption can be realized.

Note that, on a side surface 1003*a* of the housing 1001*a*, a connection terminal to which an external device is connected and one or plural buttons for operating the portable information terminal in FIG. 15A may be provided.

In the housing 1001*a* of the portable information terminal illustrated in FIG. 15A, a CPU, a main memory, an interface with which signals are transmitted/received between the external device and the CPU and the main memory, and an antenna which sends and receives the signals to/from the external device are provided. Note that in the housing 1001*a*, one or plural integrated circuits having a specific function may be provided.

An image on the display portion 1002*a* is seen with use of eyeglasses 1011*a* with shutters as illustrated in FIG. 15A, whereby a pseudo three-dimensional image can be seen. The eyeglasses 1011*a* are provided with a polarization shutter 1012*a* for the left eye and a polarization shutter 1013*a* for the right eye, and the shutters are formed using liquid crystal. For example, when an image on the display portion 1002*a* is a left-eye image, light incident on the right eye of a viewer is blocked with the shutter 1013*a* for the right eye, and when an image on the display portion 1002*a* is a right-eye image, light incident on the left eye of the viewer is blocked with the shutter 1012*a* for the left eye. As a result, the viewer can see a pseudo three-dimensional image. Note that an antenna may be provided for the eyeglasses 1011*a* and receives carrier waves including a control signal by wireless communication, so that transmitting and blocking of light by the shutter 1012*a* for the left eye and the shutter 1013*a* for the right eye are controlled.

The portable information terminal illustrated in FIG. 15A has a function of one or more of a telephone set, an electronic book, a personal computer, and a game machine.

Figure 15C:
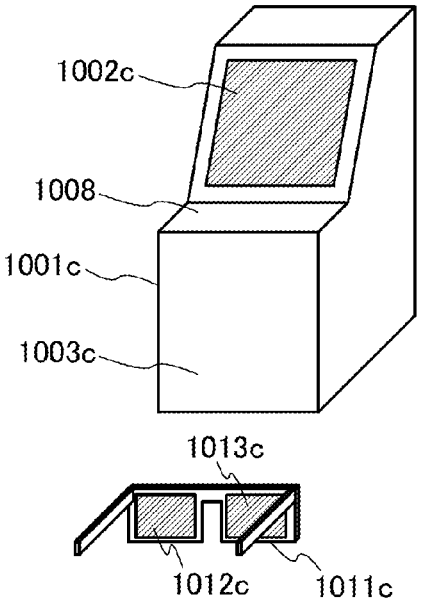
Figure 15B:
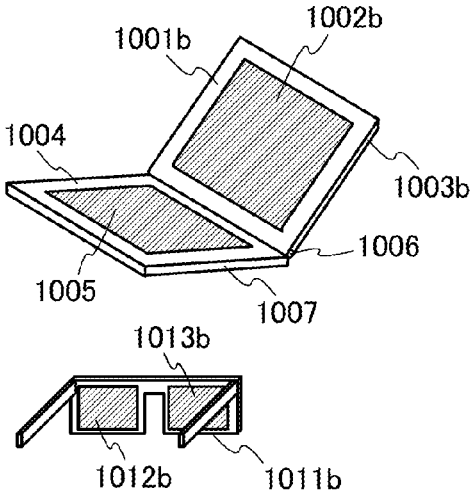

An electronic device illustrated in FIG. 15B is an example of a foldable portable information terminal. The portable information terminal illustrated in FIG. 15B includes a housing 1001*b*, a display portion 1002*b* provided in the housing 1001*b*, a housing 1004, a display portion 1005 provided in the housing 1004, and a hinge 1006 for connecting the housing 1001*b* and the housing 1004.

In the case of the portable information terminal illustrated in FIG. 15B, the housing 1001*b* or the housing 1004 is moved with the hinge 1006, whereby the housing 1001*b* can be stacked over the housing 1004.

Note that on a side surface 1003*b* of the housing 1001*b* or a side surface 1007 of the housing 1004, a connection terminal to which an external device is connected and one or plural buttons for operating the portable information terminal in FIG. 15B may be provided.

The display portion 1002*b* and the display portion 1005 may display different images or one image. Note that the display portion 1005 is not necessarily provided, and a keyboard which is an input device may be provided instead of the display portion 1005.

In the housing 1001*b* or the housing 1004 of the portable information terminal illustrated in FIG. 15B, a CPU, a main memory, and an interface with which signals are transmitted/received between the external device and the CPU and the main memory are provided. Note that in the housing 1001*b* or the housing 1004, one or plural integrated circuits having a specific function may be provided. Furthermore, for the portable information terminal illustrated in FIG. 15B, an antenna which sends and receives the signals to/from the external device may be provided.

An image on the display portion 1002*b* or the display portion 1005 is seen with use of eyeglasses 1011*b* with shutters as illustrated in FIG. 15B, whereby a pseudo three-dimensional image can be seen. The eyeglasses 1011*b* are provided with a shutter 1012*b* for the left eye and a shutter 1013*b* for the right eye, and the shutters are formed using liquid crystal. For example, when an image on the display portion 1002*b* or the display portion 1005 is a left-eye image, light incident on the right eye of a viewer is blocked with the shutter 1013*b* for the right eye, and when an image on the display portion 1002*b* or the display portion 1005 is a right-eye image, light incident on the left eye of the viewer is blocked with the shutter 1012*b* for the left eye. As a result, the viewer can see a pseudo three-dimensional image. Note that an antenna may be provided for the eyeglasses 1011*b* and receives carrier waves including a control signal by wireless communication, so that light transmitting and blocking of light by the shutter 1012*b* for the left eye and the shutter 1013*b* for the right eye are controlled.

The portable information terminal illustrated in FIG. 15B has a function of one or more of a telephone set, an electronic book, a personal computer, and a game machine.

An electronic device illustrated in FIG. 15C is an example of a stationary information terminal. The stationary information terminal in FIG. 15C includes a housing 1001*c* and a display portion 1002*c* provided in the housing 1001*c*.

Note that the display portion 1002*c* can be provided on a deck portion 1008 of the housing 1001*c*.

In the housing 1001*c* of the stationary information terminal illustrated in FIG. 15C, a CPU, a main memory, and an interface with which signals are transmitted/received between the external device and the CPU and the main memory are provided. Note that in the housing 1001*c*, one or plural integrated circuits having a specific function may be provided. Furthermore, for the stationary information terminal illustrated in FIG. 15C, an antenna which sends and receives the signals to/from the external device may be provided.

Further, on a side surface 1003*c* of the housing 1001*c* in the stationary information terminal illustrated in FIG. 15C, one or more of a ticket output portion which outputs a ticket or the like, a coin slot, and a bill slot may be provided.

An image on the display portion 1002*c* is seen with use of eyeglasses 1011*c* with shutters as illustrated in FIG. 15C, whereby a pseudo three-dimensional image can be seen. The eyeglasses 1011*c* are provided with a shutter 1012*c* for the left eye and a shutter 1013*c* for the right eye, and the shutters are formed using liquid crystal. For example, when an image on the display portion 1002*c* is a left-eye image, light incident on the right eye of a viewer is blocked with the shutter 1013*c* for the right eye, and when an image on the display portion 1002*c* is a right-eye image, light incident on the left eye of the viewer is blocked with the shutter 1012*c* for the left eye. As a result, the viewer can see a pseudo three-dimensional image. Note that an antenna may be provided for the eyeglasses 1011*c* and receives carrier waves including a control signal by wireless communication, so that light transmitting and blocking of light by the shutter 1012*c* for the left eye and the shutter 1013*c* for the right eye are controlled.

The stationary information terminal illustrated in FIG. 15C has a function of, for example, an automated teller machine, an information communication terminal (also referred to as a multimedia station) for ordering information goods such as a ticket, or a game machine.

Figure 15D:
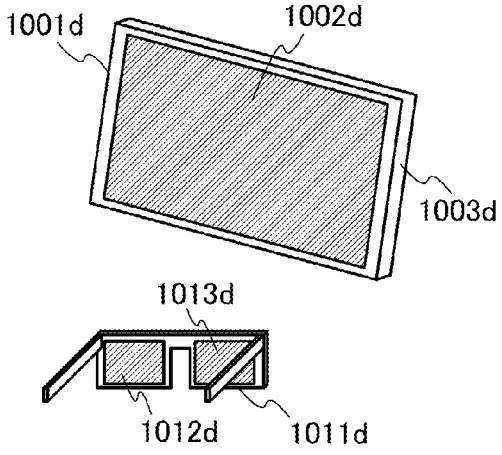

An electronic device illustrated in FIG. 15D is an example of a stationary information terminal. The stationary information terminal illustrated in FIG. 15D includes a housing 1001*d* and a display portion 1002*d* provided in the housing 1001*d*. Note that a supporting base which supports the housing 1001*d* may be provided.

Note that on a side surface 1003*d* of the housing 1001*d*, a connection terminal to which an external device is connected and one or plural buttons for operating the stationary information terminal in FIG. 15D may be provided.

In the housing 1001*d* of the stationary information terminal illustrated in FIG. 15D, a CPU, a main memory, and an interface with which signals are transmitted/received between the external device and the CPU and the main memory may be provided. Further, in the housing 1001*d*, one or plural integrated circuits having a specific function may be provided. Furthermore, an antenna which sends and receives the signals to/from the external device may be provided in the stationary information terminal illustrated in FIG. 15D.

An image on the display portion 1002*d* is seen with use of eyeglasses 1011*d* with shutters as illustrated in FIG. 15D, whereby a pseudo three-dimensional image can be seen. The eyeglasses 1011*d* are provided with a shutter 1012*d* for the left eye and a shutter 1013*d* for the right eye, and the shutters are formed using liquid crystal. For example, when an image on the display portion 1002*d* is a left-eye image, light incident on the right eye of a viewer is blocked with the shutter 1013*d* for the right eye, and when an image on the display portion 1002*d* is a right-eye image, light incident on the left eye of the viewer is blocked with the shutter 1012*d* for the left eye. As a result, the viewer can see a pseudo three-dimensional image. Note that an antenna may be provided for the eyeglasses 1011*d* and receives carrier waves including a control signal by wireless communication, so that light transmitting and blocking by the shutter 1012*d* for the left eye and the shutter 1013*d* for the right eye are controlled.

The stationary information terminal illustrated in FIG. 15D has a function of, for example, a digital photo frame, an input-output monitor, or a television set.

The liquid crystal display device described in the above embodiment is used for a display portion of an electronic device, and for example, used for the display portions 1002*a* to 1002*d* illustrated in FIGS. 15A to 15D. Further, the liquid crystal display device of the above embodiment may be used for the display portion 1005 illustrated in FIG. 15B.

As description with reference to FIGS. 15A to 15D, the example of the electronic device of this embodiment has a structure in which the display portion including the liquid crystal display device described in the above embodiment is provided. With such a structure, an image on the display portion can be seen as a pseudo three-dimensional image.

Further, in the example of the electronic device of this embodiment, the housing may be provided with one or more of a photoelectric conversion portion which generates power supply voltage in accordance with incident illuminance and an operation portion for operating the liquid crystal display device. For example, when the photoelectric conversion portion is provided, an external power supply is not needed; thus, the electronic device can be used for a long time even in an environment where an external power supply is not provided.

This application is based on Japanese Patent Application serial no. 2010-260717 filed with Japan Patent Office on Nov. 23, 2010, the entire contents of which are hereby incorporated by reference.

What is claimed is:

1. A method for driving a display device, wherein the display device includes:

a pixel portion comprising:

a first region;

a second region adjacent to the first region;

a third region adjacent to the second region; and a plurality of backlight units, wherein each of the first region, the second region, and the third region comprises a plurality of pixels arranged in matrix, the method comprising the steps of:

providing a right-eye image display period and a left-eye image display period alternately, wherein each of the right-eye image display period and the left-eye image display period includes a first subframe period, a second subframe period, a third subframe period, and a fourth subframe period;

during the first subframe period, supplying a first hue signal to each of the plurality of pixels of the first region;

during the first subframe period, supplying light of a first hue to each of the plurality of pixels of the first region by a first part of the plurality of the backlight units in response to the first hue signal;

during the first subframe period, supplying a third hue signal to each of the plurality of pixels of the second region;

during the first subframe period, supplying light of a third hue to each of the plurality of pixels of the second region by a second part of the plurality of the backlight units in response to the third hue signal;

during the first subframe period, supplying a second hue signal to each of the plurality of pixels of the third region;

during the first subframe period, supplying light of a second hue to each of the plurality of pixels of the second region by a third part of the plurality of the backlight units in response to the second hue signal;

during the second subframe period, supplying the second hue signal to each of the plurality of pixels of the first region;

during the second subframe period, supplying light of the second hue to each of the plurality of pixels of the first region by the first part of the plurality of the backlight units in response to the second hue signal;

during the second subframe period, supplying the first hue signal to each of the plurality of pixels of the second region;

during the second subframe period, supplying light of the first hue to each of the plurality of pixels of the second region by the second part of the plurality of the backlight units in response to the first hue signal;

during the second subframe period, supplying the third hue signal to each of the plurality of pixels of the third region;

during the second subframe period, supplying light of the third hue to each of the plurality of pixels of the third region by the third part of the plurality of the backlight units in response to the third hue signal;

during the third subframe period, supplying the third hue signal to each of the plurality of pixels of the first region;

during the third subframe period, supplying light of the third hue to each of the plurality of pixels of the first region by the first part of the plurality of the backlight units in response to the third hue signal;

during the third subframe period, supplying the second hue signal to each of the plurality of pixels of the second region;

during the third subframe period, supplying light of the second hue to each of the plurality of pixels of the second region by the second part of the plurality of the backlight units in response to the second hue signal;

during the third subframe period, supplying the first hue signal to each of the plurality of pixels of the third region;

during the third subframe period, supplying light of the first hue to each of the plurality of pixels of the third region by the third part of the plurality of the backlight units in response to the first hue signal; and during the fourth subframe period, turning off the first part of the plurality of the backlight units, the second part of the plurality of the backlight units and the third part of the plurality of the backlight units, wherein the plurality of pixels of the first region includes a first pixel that is adjacent to the second region, wherein during the first subframe period, holding the third hue signal in the first pixel, wherein the second subframe period is adjacent to the first subframe period, wherein the third subframe period is adjacent to the second subframe period, and wherein the fourth subframe period is adjacent to the third subframe period.

2. The method for driving a display device according to claim 1, wherein the first hue signal, the second hue signal, and the third hue signal are different from one another.

3. A method for driving a display device, wherein the display device includes:

a pixel portion comprising:

a first region;

a second region adjacent to the first region;

a third region adjacent to the second region; and a plurality of backlight units;

wherein each of the first region, the second region, and the third region comprises a plurality of pixels arranged in matrix, the method comprising the steps of:

providing a right-eye image display period and a left-eye image display period alternately, wherein each of the right-eye image display period and the left-eye image display period includes a first subframe period, a second subframe period, a third subframe period, and a fourth subframe period;

during the first subframe period, supplying a first hue signal to each of the plurality of pixels of the first region;

during the first subframe period, supplying light of a first hue to each of the plurality of pixels of the first region by a first part of the plurality of the backlight units in response to the first hue signal;

during the first subframe period, supplying a third hue signal to each of the plurality of pixels of the second region;

during the first subframe period, supplying light of a third hue to each of the plurality of pixels of the second region by a second part of the plurality of the backlight units in response to the third hue signal;

during the first subframe period, supplying a second hue signal to each of the plurality of pixels of the third region;

during the first subframe period, supplying light of a second hue to each of the plurality of pixels of the second region by a third part of the plurality of the backlight units in response to the second hue signal;

during the second subframe period, supplying the second hue signal to each of the plurality of pixels of the first region;

during the second subframe period, supplying light of the second hue to each of the plurality of pixels of the first region by the first part of the plurality of the backlight units in response to the second hue signal;

during the second subframe period, supplying the first hue signal to each of the plurality of pixels of the second region;

during the second subframe period, supplying light of the first hue to each of the plurality of pixels of the second region by the second part of the plurality of the backlight units in response to the first hue signal;

during the second subframe period, supplying the third hue signal to each of the plurality of pixels of the third region;

during the second subframe period, supplying light of the third hue to each of the plurality of pixels of the third region by the third part of the plurality of the backlight units in response to the third hue signal;

during the third subframe period, supplying the third hue signal to each of the plurality of pixels of the first region;

during the third subframe period, supplying light of the third hue to each of the plurality of pixels of the first region by the first part of the plurality of the backlight units in response to the third hue signal;

during the third subframe period, supplying the second hue signal to each of the plurality of pixels of the second region;

during the third subframe period, supplying light of the second hue to each of the plurality of pixels of the second region by the second part of the plurality of the backlight units in response to the second hue signal;

during the third subframe period, supplying the first hue signal to each of the plurality of pixels of the third region;

during the third subframe period, supplying light of the first hue to each of the plurality of pixels of the third region by the third part of the plurality of the backlight units in response to the first hue signal; and during the fourth subframe period, turning off the first part of the plurality of the backlight units, the second part of the plurality of the backlight units and the third part of the plurality of the backlight units, wherein the plurality of pixels of the second region includes a first pixel that is adjacent to the third region, wherein during the first subframe period, holding the third hue signal in the first pixel, wherein the second subframe period is adjacent to the first subframe period, wherein the third subframe period is adjacent to the second subframe period, and wherein the fourth subframe period is adjacent to the third subframe period.

4. The method for driving a display device according to claim 3, wherein the first hue signal, the second hue signal, and the third hue signal are different from one another.

* * * * *